US011228118B2

(12) United States Patent
Kang et al.

(10) Patent No.: US 11,228,118 B2
(45) Date of Patent: Jan. 18, 2022

(54) ANTENNA MODULE AND ELECTRONIC DEVICE

(71) Applicant: Samsung Electro-Mechanics Co., Ltd., Suwon-si (KR)

(72) Inventors: Ho Kyung Kang, Suwon-si (KR); Gil Ha Lee, Suwon-si (KR); Shin Haeng Heo, Suwon-si (KR); Hyung Ho Seo, Suwon-si (KR); Hong Cheol Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 157 days.

(21) Appl. No.: 16/659,703

(22) Filed: Oct. 22, 2019

(65) Prior Publication Data

US 2020/0403321 A1 Dec. 24, 2020

(30) Foreign Application Priority Data

Jun. 21, 2019 (KR) ..... 10-2019-0073945

(51) Int. Cl.
*H01Q 21/00* (2006.01)
*H01Q 21/06* (2006.01)
(Continued)

(52) U.S. Cl.
CPC ..... *H01Q 21/065* (2013.01); *H01Q 1/02* (2013.01); *H01Q 1/2283* (2013.01);
(Continued)

(58) Field of Classification Search
CPC ..... H01Q 21/065; H01Q 21/0025; H01Q 21/0087; H01Q 9/045; H01Q 1/02; H01Q 1/243; H01Q 1/2283; H01Q 9/0414
See application file for complete search history.

(56) References Cited

U.S. PATENT DOCUMENTS 9,343,817 B2 5/2016 Pan
2016/0187938 A1* 6/2016 Han ..... G06F 1/1679 361/679.27

(Continued)

FOREIGN PATENT DOCUMENTS

JP 2003-87022 A 3/2003
JP 2005-347912 A 12/2005
KR 10-2019-0065112 A 6/2019

OTHER PUBLICATIONS

Korean Office Action dated Oct. 27, 2020 in counterpart Korean Patent Application No. 10-2019-0073945 (8 pages in English, 6 pages in Korean).

*Primary Examiner* — David E Lotter
(74) *Attorney, Agent, or Firm* — NSIP Law

(57) ABSTRACT

An antenna module includes: an integrated circuit (IC) package including an IC, first and second antenna parts including first and second patch antenna patterns, first and second feed vias, and first and second dielectric layers, respectively; a connection member having a laminated structure having a first surface on which the first and second antenna parts are disposed, and a second surface, on which the IC package is disposed, the connection member further including an electrical connection path between the IC and the first and second feed vias. The connection member has a first region and a second region that is more flexible than the first dielectric layer. The first and second antenna parts are disposed on the first and second regions, respectively. Either one or both of the first and second antenna parts further includes a connection structure having a lower melting point than the first or second feed via.

19 Claims, 23 Drawing Sheets

(51) Int. Cl.

| | |
|---|---|
| ***H01Q 1/22*** | (2006.01) |
| ***H01Q 9/04*** | (2006.01) |
| ***H01Q 1/02*** | (2006.01) |
| *H01Q 1/24* | (2006.01) |

(52) U.S. Cl.
CPC ..... *H01Q 9/045* (2013.01); *H01Q 21/0025* (2013.01); *H01Q 21/0087* (2013.01); *H01Q 1/243* (2013.01)

(56) References Cited

U.S. PATENT DOCUMENTS

| | | | | |
|---|---|---|---|---|
| 2018/0026341 | A1* | 1/2018 | Mow | H04B 10/90 343/702 |
| 2019/0173176 | A1 | 6/2019 | Kim et al. | |
| 2020/0194893 | A1* | 6/2020 | Im | H01L 23/5387 |
| 2020/0373646 | A1* | 11/2020 | Murata | H01Q 1/2283 |

* cited by examiner

ANTENNA MODULE AND ELECTRONIC DEVICE

CROSS-REFERENCE TO RELATED APPLICATIONS

This application claims the benefit under 35 U.S.C. § 119(a) of Korean Patent Application No. 10-2019-0073945 filed on Jun. 21, 2019 in the Korean Intellectual Property Office, the entire disclosure of which is incorporated herein by reference for all purposes.

BACKGROUND

1. Field

The following description relates to an antenna module and an electronic device including the antenna module.

2. Description of Related Art

Data traffic of mobile communications is increasing rapidly every year. Technological development to support such a leap in data amounts transmitted in real time in wireless networks is underway. For example, applications of the contents of Internet of Things (IoT) based data, live VR/AR in combination with augmented reality (AR), virtual reality (VR), and social networking services (SNS), autonomous navigation, a synch view for real-time image transmission from a user's viewpoint using a subminiature camera, and the like, require communications for supporting the exchange of large amounts of data, for example, 5th generation (5G) communications, mmWave communications, or the like.

Accordingly, millimeter wave (mmWave) communications, including 5G communications, have been researched, and research into the commercialization/standardization of radio-frequency (RF) modules to smoothly implement such millimeter wave (mmWave) communications has been undertaken.

Radio-frequency (RF) signals in high frequency bands (e.g., 28 GHz, 36 GHz, 39 GHz, 60 GHz, or the like) are easily absorbed in the course of transmissions and lead to loss. Thus, the quality of communications may decrease dramatically. Therefore, antennas for communications in high-frequency bands require an approach different from the antenna technology of the related art, and may require a special technological development, such as for a separate power amplifier, for securing an antenna gain, integration of an antenna and an RFIC, and effective isotropic radiated power (EIRP), or the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna module includes: an integrated circuit (IC) package including an IC; a first antenna part including a first patch antenna pattern, a first feed via electrically connected to the first patch antenna pattern, and a first dielectric layer surrounding the first feed via; a second antenna part including a second patch antenna pattern, a second feed via electrically connected to the second patch antenna pattern, and a second dielectric layer surrounding the second feed via; and a connection member having a laminated structure having a first surface, on which the first and second antenna parts are disposed, and a second surface, on which the IC package is disposed, opposing the first surface, the connection member further including an electrical connection path between the IC and the first and second feed vias. The connection member has a first region overlapping the IC package, and a second region not overlapping the IC package and being more flexible than the first dielectric layer. The first antenna part is disposed on the first region. The second antenna part is disposed on the second region. Either one or both of the first antenna part and the second antenna part further includes a connection structure disposed on the first surface to electrically connect the first feed via or the second feed via and the connection member to each other, and having a melting point lower than a melting point of the first feed via or the second feed via.

The first antenna part may be configured to have a first resonant frequency. The second antenna part may be configured to have a second resonant frequency different from the first resonant frequency.

The connection member may further include a third region extending from the first region in a direction different from a direction in which the second region extends. The third region may include a disposition space of a base signal line, through which a signal having a frequency lower than the first and second resonant frequencies passes, electrically connected to the IC.

The IC package may further include: a core member spaced apart from the IC, and including a core via and a core insulating layer; a first electrical connection structure electrically connecting an end of the core via and the connection member to each other; and a second electrical connection structure electrically connected to another end of the core via.

The IC package may further include: a heat slug disposed on an inactive surface of the IC; and a third electrical connection structure electrically connected to the heat slug and disposed at a same height as a height of the second electrical connection structure. The IC may be electrically connected to the connection member through a surface opposing the inactive surface.

The IC package may further include: a plating member disposed in the core member; a passive component electrically connected to the connection member; and an encapsulant encapsulating the IC and the passive component.

The first region has a thickness greater than a thickness of the second region.

The second region includes a rigid region overlapping the second connection part, and a flexible region not overlapping the second antenna part and being more flexible than the rigid region.

The antenna module may further include an end-fire antenna disposed on either one or both of the rigid region and the first region.

Either one or both of the first antenna part and the second antenna part further includes a coupling patch pattern disposed over the first or second patch antenna pattern and spaced apart from the first patch antenna pattern or the second patch antenna pattern.

Either one or both of the first antenna part and the second antenna part may further include a polymer layer disposed between the first patch antenna pattern or the second patch antenna pattern and the coupling patch pattern. The first dielectric layer or the second dielectric layer may be formed of a ceramic material.

The first antenna part may have a structure in which first patch antenna patterns including the first patch antenna pattern are arranged side-by-side in a first direction. The second antenna part may have a structure in which second patch antenna patterns including the second patch antenna pattern are arranged side-by-side in the first direction.

The first patch antenna patterns and the second patch antenna patterns may be arranged together side-by-side.

The first antenna part may have a structure in which first patch antenna patterns including the first patch antenna pattern are arranged side-by-side in a first direction. The second antenna part may have a structure in which second patch antenna patterns including the second patch antenna pattern are arranged side-by-side in a second direction different from the first direction.

The first patch antenna patterns may be configured to have a first resonant frequency. The second patch antenna patterns may be configured to have a second resonant frequency different from the first resonant frequency.

In another general aspect, an electronic device includes: a case; a set substrate disposed in the case; and an antenna module disposed in the case and electrically connected to the set substrate, the antenna module including an integrated circuit (IC) package including an IC; a first antenna part including a first patch antenna pattern, a first feed via electrically connected to the first patch antenna pattern, and a first dielectric layer surrounding the first feed via; a second antenna part including a second patch antenna pattern, a second feed via electrically connected to the second patch antenna pattern, and a second dielectric layer surrounding the second feed via; a connection member having a laminated structure having a first surface, on which the first and second antenna parts are disposed, and a second surface, on which the IC package is disposed, opposing the first surface, the connection member further including an electrical connection path between the IC and the first and second feed vias. The connection member has a first region overlapping the IC package and a second region not overlapping the IC package and being more flexible than the first dielectric layer. The first antenna part is disposed on the first region. The second antenna part is disposed on the second region. Either one or both of the first antenna part and the second antenna part further includes a connection structure disposed on the first surface to electrically connect the first feed via or the second feed via and the connection member to each other, and having a melting point lower than a melting point of the first feed via or the second feed via.

The connection member may further include a third region electrically connecting the second region and the set substrate to each other and being more flexible than the first dielectric layer.

The case may include a first case surface and a second case surface having an area smaller than an area of the first case surface. The first antenna part may have a structure in which first patch antenna patterns including the first patch antenna pattern are arranged side-by-side in a first direction. The second antenna part may have a structure in which second patch antenna patterns including the second patch antenna pattern are arranged side-by-side in a second direction different from the first direction, and the second antenna part may be disposed closer to the second case surface than the first antenna part.

The first antenna part may be configured to have a first resonant frequency. The second antenna part may be configured to have a second resonant frequency different from the first resonant frequency.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
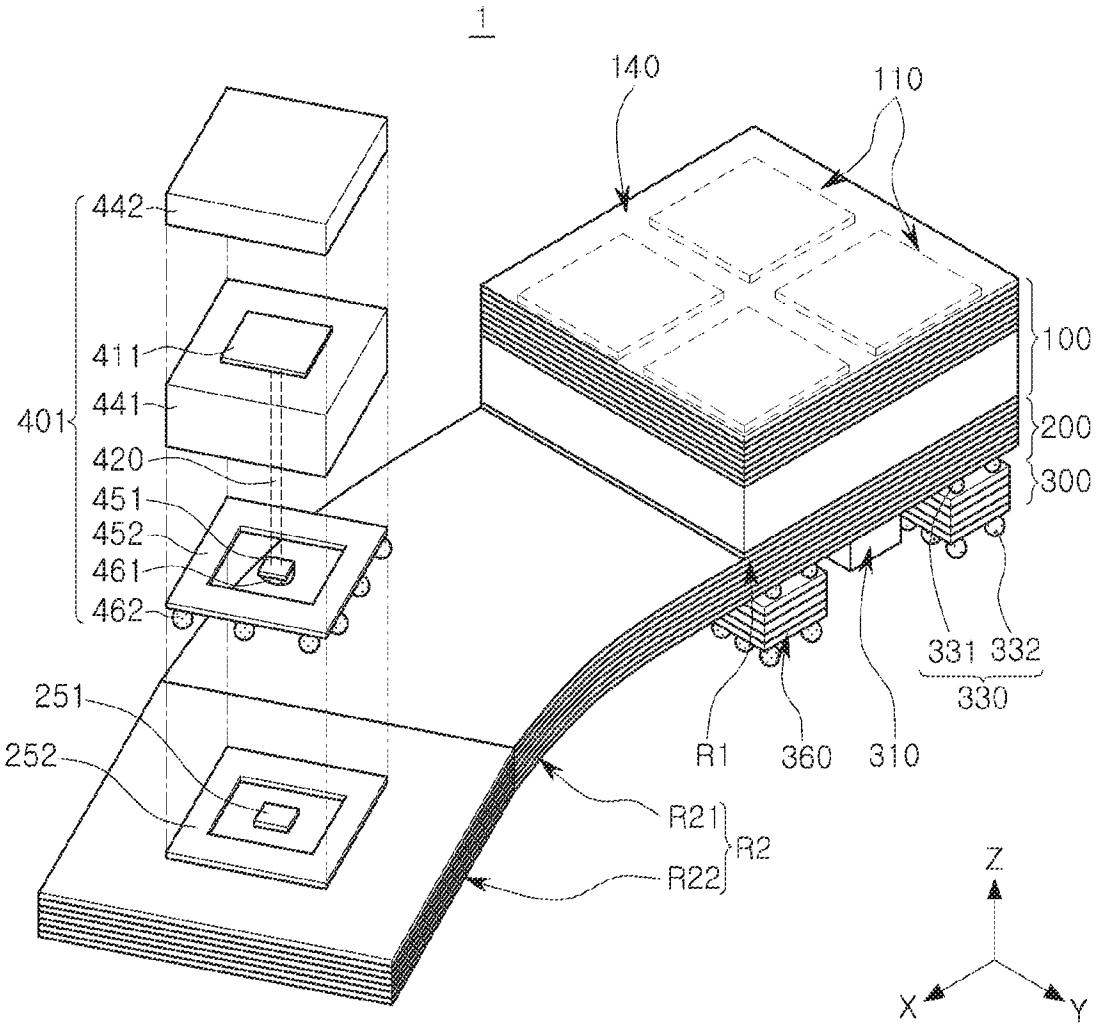
FIG. 1 is a perspective view of an antenna module, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a perspective view of an antenna module 1 according to an example.

Referring to FIG. 1, the antenna module 1 may include a first antenna part 110, a connection member 200, an IC package 300, and a second antenna part 400.

The first antenna part 100 may include a first patch antenna pattern 110 and may further include a first dielectric layer 140, and may remotely transmit and/or receive a radio-frequency (RF) signal in a Z direction. The greater the number of first patch antenna patterns 110, the higher a gain of the first antenna part 100 may be.

The first patch antenna pattern 110 may be designed to have relatively high transmission efficiency for a frequency band corresponding to a frequency of an RF signal. The first patch antenna pattern 110 may have an upper plane and a lower plane. The planes may act as a boundary through which most energy of the RF signal is transmitted between a conductive medium and air or the first dielectric layer 140.

The first dielectric layer 140 may have a higher dielectric constant than air and may affect a shape and a size of the first antenna part 100.

The IC package 300 may include an IC 310 and may further include a core member 360 and an electrical connection structure 330.

The IC 310 may perform frequency conversion, amplification, filtering, phase control, or the like, on a base signal to generate an RF signal, and may generate the base signal from the RF signal based on a similar principle. The base signal has a frequency lower than a frequency of the RF signal, and may have a base band frequency or an intermediate frequency (IF) frequency.

The core member 360 may provide a transmission path of the base signal, and may physically support the antenna module 1.

The electrical connection structure 330 may include a first electrical connection structure 331 electrically connecting the core member 360 and the connection member 200 to each other, and a second electrical structure 332 electrically connecting the core member 360 and a set substrate. For example, the electrical connection structure 330 may have a structure such as a solder ball, a pin, a land, or a pad.

The connection member 200 includes a portion disposed between the first antenna part 100 and the IC package 300, and has a laminated structure configured to electrically connect the first patch antenna pattern 110 and the IC 310 to each other. The connection member 200 may easily decrease an electrical length between the first patch antenna pattern 110 and the IC 310 depending on the laminated structure.

Since the RF signal has a relatively higher frequency and a shorter wavelength than the base signal, the RF signal may be lost relatively more than the base signal during transmission. Since the connection member 200 may decrease the electrical length between the first antenna part 100 and the IC package 300, loss of the RF signal may be reduced when the RF signal flows between the IC 310 and the first patch antenna pattern 110.

The second antenna part 400 may include a second patch antenna pattern 411, a second feed via 420, a second dielectric layer 441, and an antenna connection structure 461.

The second patch antenna pattern 411 may remotely transmit and/or receive an RF signal in direction normal to a top surface thereof, and may have electromagnetic characteristics similar to those of the first patch antenna pattern 110.

For example, the second patch antenna pattern 411 may be disposed on a top surface of the second dielectric layer 441.

The second feed via 420 may electrically connect the second patch antenna pattern 411 and the connection member 200 to each other, and may serve as an electrical path of the RF signal.

For example, the second feed via 420 may be formed by filling a through-hole of the second dielectric layer 441.

The antenna connection structure 461 may electrically connect the second feed via 420 and the connection member 200 to each other, and may have a melting point lower a melting point of the second feed via 420.

Accordingly, the second antenna part 400 may be disposed on the connection member 200 after being manufactured separately from the connection member 200. For example, the second antenna part 400 may be additionally manufactured and may be then disposed on the top surface of the connection member 200 such that the antenna feed pattern 451 and the connection member feed pattern 251 overlap each other. The antenna connection structure 461 is disposed to be in contact with the antenna feed pattern 451 and the connection member feed pattern 251 at a temperature higher than the melting point of the antenna connection structure 461 and lower than the melting point of the second feed via 420. As a result, the second antenna part 400 may be mounted on the connection member 200.

For example, the second antenna part 400 may further include an antenna ground pattern 452 disposed on a bottom surface of the second dielectric layer 441, and may be electrically connected to a connection member ground pattern 252. The antenna ground pattern 452 may be electrically connected to the connection member ground pattern 252 through a ground connection structure 462. The ground connection structure 462 may have substantially the same characteristics as the antenna connection structure 461.

Accordingly, the second antenna part 400 may be more stably fixed to the connection member 200.

The second dielectric layer 441 may have a dielectric constant higher than the dielectric constant of air, and may affect the shape and the size of the second antenna part 400.

For example, since the second dielectric layer 441 may be formed of ceramic, the second dielectric layer 441 may have a dielectric constant higher than a dielectric constant of an insulating layer of the connection member 200. Since the second antenna part 400 may be disposed on the connection member 200 after being manufactured separately from the connection member 200, the second dielectric layer 441 may be designed without consideration of structural compatibility with the connection member 200. Thus, the second dielectric layer 441 may be more easily implemented with a material having a relatively high dielectric constant, such as a ceramic.

The higher the dielectric constant of the second dielectric layer 441, the shorter an effective wavelength of the RF signal in the second dielectric layer 441 may be. The shorter the effective wavelength of the RF signal in the second dielectric layer 441, the smaller an overall size of the second antenna part 400 may be.

The greater the number of the second patch antenna patterns 411, the higher a gain of the second antenna part 400 may be. The entire size of the second antenna part 400 may be in proportion to the number of second patch antenna patterns 411.

Accordingly, the higher the dielectric constant of the second dielectric layer 441, the higher the gain to the size of the second antenna part 400.

Since the second dielectric layer 441 may be more easily implemented with a material having a relatively high dielectric constant, the antenna module 1 may more easily improve the gain with respect to the size of the second antenna part 400.

In addition, the second antenna part 400 may be configured to have a second resonant frequency that is different from the first resonant frequency of the first antenna part 100. For example, the antenna module 1 may remotely transmit and receive the RF signal of the first frequency through the first antenna part 100 and may remotely transmit and receive the RF signal of the second frequency through the second antenna part 400.

Since loss of the RF signal per propagation distance in the air may be in proportion to the square of the frequency of the RF signal, the antenna module 1 may have a higher gain for the RF signal having a higher frequency, of the first and second frequencies, to have balanced antenna performance for the first and second frequencies.

Since the second antenna part 400 may more easily increase the gain with respect to the size, the second antenna part 400 may more easily provide antenna performance for a higher frequency.

For example, in the antenna module 1, the first and second antenna parts 100 and 400 are configured to have first and second resonant frequencies that are different from each other. Thus, the antenna module 1 may have balanced antenna performance for the first and second frequencies.

In addition, since the first and second antenna parts 100 and 400 are disposed in different locations of the connection member 200, the antenna module 1 may reduce electromagnetic interference between the first and second antenna parts 100 and 400. Thus, the antenna module 1 may have balanced antenna performance for the first and second frequencies.

The second antenna part 400 may further include a polymer layer 442 disposed on the second patch antenna pattern 411. The polymer layer 442 may have a dielectric constant lower than a dielectric constant of the second dielectric layer 441. Depending on the difference in dielectric constants between the polymer layer 442 and the second dielectric layer 441, a boundary between the polymer layer 442 and the second dielectric layer 441 may act as a boundary condition for a remotely transmitted and received RF signal. The RF signal may be refracted in a direction normal to the second patch antenna pattern 411 at the boundary. Accordingly, the gain of the second patch antenna pattern 411 may be further increased.

The connection member 200 may include a first region R1 disposed between the first antenna part 100 and the IC package 300, and a second region R2 extending farther than the first antenna part 100 in a direction (for example, an X direction and/or a Y direction) different from a laminated direction (for example, the Z direction) of the connection member 200.

Since the second region R2 may improve the degree of positional freedom of the connection member 200, the second region R2 may provide an additional disposition space other than the first antenna part 100 and the IC package 300.

The second antenna part 400 is disposed in the second region R2 of the connection member 200. Accordingly, the antenna module according to an example may easily provide an additional disposition space of the second antenna part 400, and may easily reduce sizes of the first antenna part 100 and the IC package 300.

The second region R2 of the connection member 200 may be formed of a material that is more flexible than a material of the first antenna part 100 or the first region R1. For example, the connection member 200 may be implemented as a rigid-flexible printed circuit board (RFPCB).

For example, the connection member 200 may have a structure in which, in a rigid-flexible printed circuit board including a second insulating layer of a central layer formed of a material relatively more flexible (for example, polyimide) than a material of a first insulating layer of upper and lower layers, a portion of the upper layer and the lower layer is cut away.

The second region R2 may correspond to a region of the connection member 200 in which the portion of the upper layer and the lower layer is cut away. Accordingly, the first region R1 of the connection member 200 may have a thickness that is greater than a thickness of the second region R2. When the thickness of the first region R1 is greater than the thickness of the second region R2, the first region R1 may more easily secure a disposition space of wiring and ground layers which may be used in the IC 310.

Since the second region R2 may be flexibly bent, the second region R2 may be disposed closer to the IC package 300 or the first antenna part 100.

Accordingly, the antenna module 1 may provide a disposition space of the second antenna part 400 and may suppress an increase in actual size of the antenna module 1 or may significantly reduce a negative effect caused by an increase in size (for example, a limitation in the degree of freedom of disposition in an electronic device, a limitation in the degree of freedom of disposition in other components of the electronic device, a deterioration in electromagnetic shielding efficiency or heat dissipation efficiency of the electronic device, and the like).

In addition, the top and/or bottom surface of the second region R2 may be inclined as the second region R2 is bent. In this case, a normal direction of the second patch antenna pattern 411 of the second antenna part 400 may also be inclined. Accordingly, the RF signal remote transmission and reception direction of the second antenna part 400 may be changed.

For example, since the antenna module 1 may easily adjust the direction and position of the RF signal remote transmission and reception of the second antenna part 400, the remote transmission and reception of an RF signal may be efficiently performed by avoiding an external obstacle (for example, another component in the electronic device, a hand of a user using the electronic device, or the like).

In addition, since the second region R2 and a surrounding structure thereof may prevent electromagnetic interference between the first and second antenna parts 100 and 400 as the second region R2 is bent, electromagnetic interference between the first and second antenna parts 100 and 400 may be more easily reduced.

The second region R2 of the connection member 200 may include a rigid region (R22), providing a disposition space of the second antenna part 400, and a flexible region R21 connecting the first region R1 and the rigid region R22 to each other and being more flexible than the rigid region R22.

Accordingly, the second antenna part 400 may be stably disposed in the rigid region R22 even if the flexible region R21 is bent.

Depending on a design, the second region R2 of the connection member 200 may not include the rigid region R22. For example, a portion of the insulating layer of the connection member 200 may provide a disposition space of the second antenna part 400.

A criterion of flexibility of a dielectric layer and/or an insulating layer may be defined as force applied to a measurement target having a unit size by applying the force to a center of one side surface of a measurement target and increasing the force until the measurement target is damaged (for example, cutting, cracking, or the like).

Figure 2A:
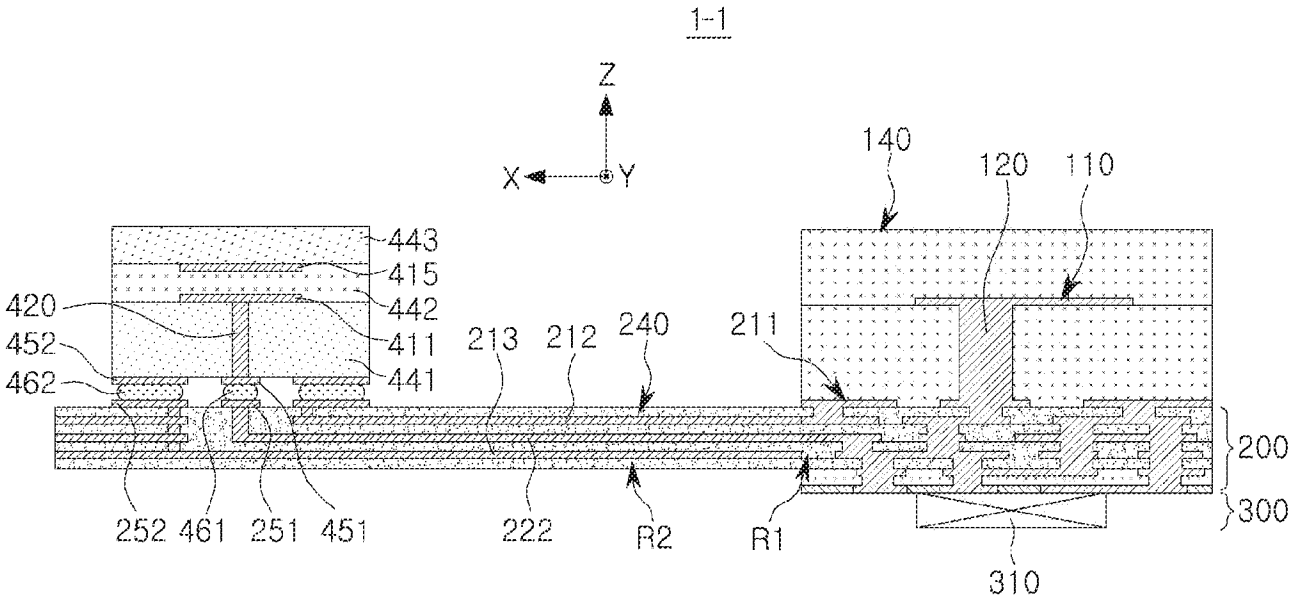
FIGS. 2A to 2C are side views of antenna modules, according to embodiments.
Figure 2B:
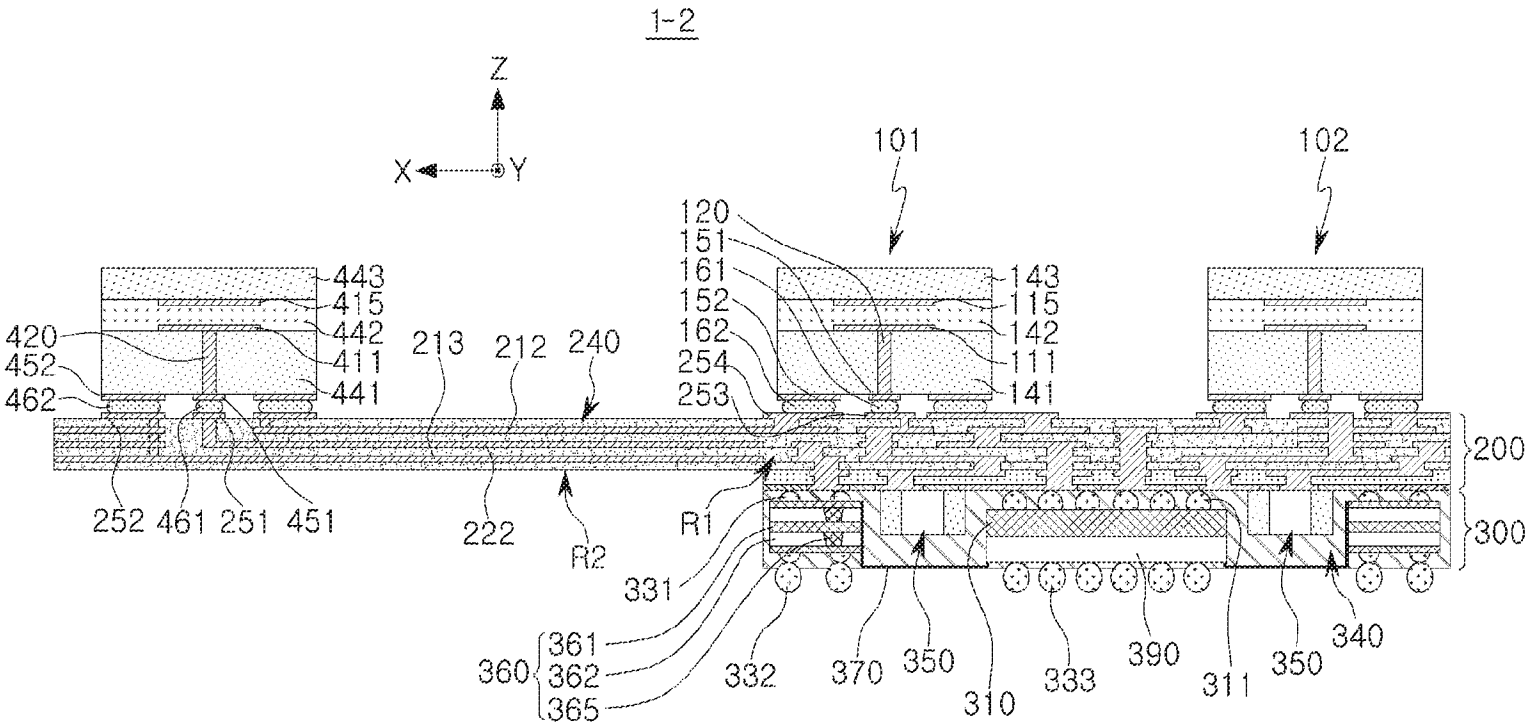
Figure 2C:
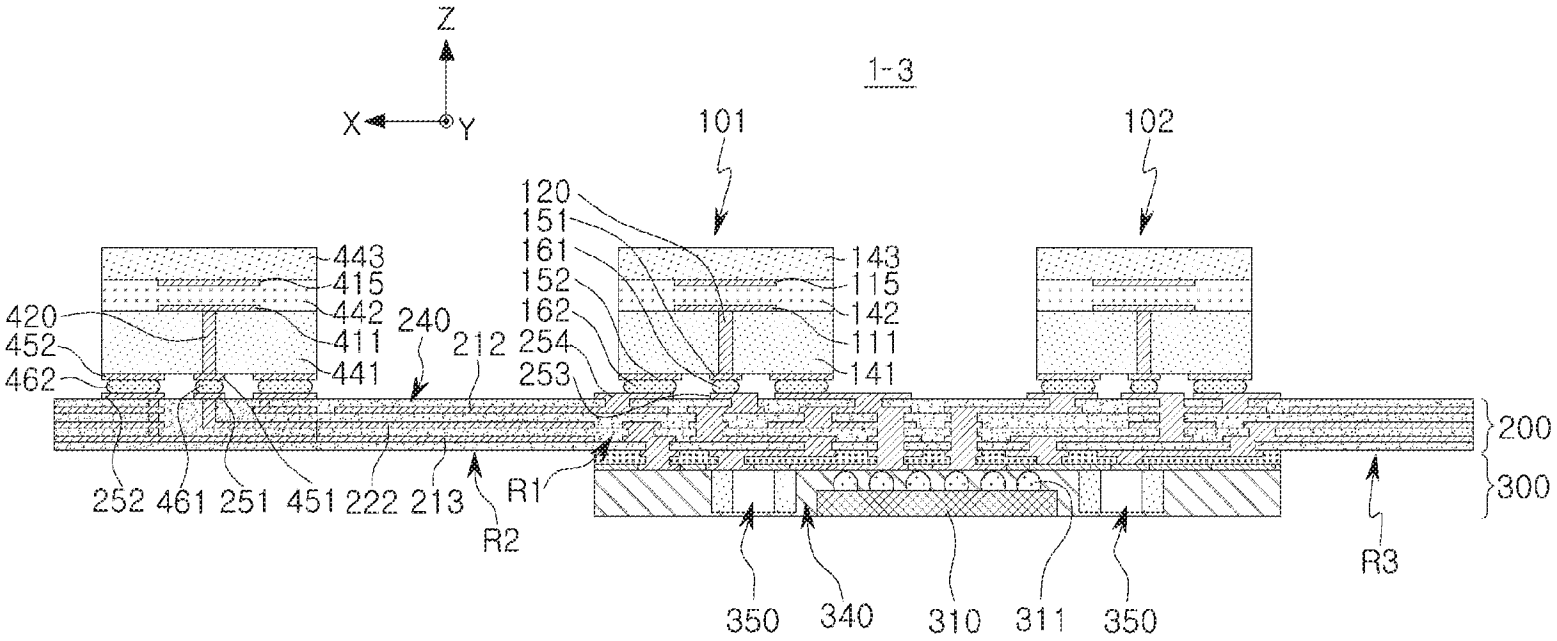

FIGS. 2A to 2C are side views of antenna modules 1-1, 1-2, and 1-3, according to examples.

Referring to FIG. 2A, in the antenna module 1-1, the connection member 200 may have a structure in which insulating layers 240 and conductive layers are alternately laminated. The conductive layer may include a first ground layer 211, a second ground layer 212, a third ground layer 213, and a second feed line 222.

The insulating layer 240 may be more flexible than the first dielectric layer 140 of the first antenna part 100. For example, the insulating layer 240 may be formed of a relatively flexible material such as polyimide or liquid crystal polymer (LCP), but the insulating layer 240 is not limited to an LCP.

The first, second and third ground layers 211, 212, and 213 may be electrically grounded.

Since the first ground layer 211 may act as a reflector for a first patch antenna pattern 110 of the first antenna part 100, an RF signal is transmitted to the first ground layer 211 through a lower plane of the first patch antenna pattern 110. The RF signal may be reflected in the Z direction.

The second and third ground layers 212 and 213 may be spaced apart from each other above and below the second feed line 222, and at least a portion of the second and third ground layers 212 and 213 may be disposed in the second region R2 of the connection member 200.

Accordingly, since the second and third ground layers 212 and 213 may be electromagnetically shielded from the outside environment, an effect of an electromagnetic noise on an RF signal transmitted through the second feed line 222, may be reduced.

In addition, the second ground layer 212 may be electrically connected to a second electrode 412 of the second antenna part 400 to provide a ground to the second antenna part 400. The second ground layer 212 may be connected to the first ground layer 211 to dissipate heat of the first region R1 of the connection member 200 through the second region R2.

The second feed line 222 may electrically connect the second patch antenna pattern 411 of the second antenna part 400 and the IC 310 to each other.

Referring to FIG. 2B, in the antenna module 1-2, each of first antenna parts 101 and 102 may include a first patch antenna pattern 111, a first coupling patch pattern 115, the first feed via 120, first dielectric layers 141 and 143, a polymer layer 142, an antenna feed pattern 151, an antenna ground pattern 152, and an antenna connection structure 161, and may be disposed on a connection member feed pattern 253 and a connection member ground pattern 254. The antenna ground pattern 152 may be electrically connected to the connection member ground pattern 254 through a ground connection structure 162.

For example, the first antenna parts 101 and 102 may be designed to have substantially the same structure as the second antenna part 400 described above with reference to FIG. 1. For example, the first antenna part 101 may be mounted on the first region R1 of the connection member 200 after being manufactured separately from the connection member 200, depending on a design.

The coupling patch pattern 115 of the first antenna parts 101 and 102 may be electromagnetically coupled to the first patch antenna pattern 111 to provide an additional resonant frequency point. Accordingly, a bandwidth of the first patch antenna pattern 111 may be easily widened.

In addition, the second antenna part 400 may also include a coupling patch pattern 415 to easily widen the bandwidth of the second patch antenna pattern 411.

Referring to FIG. 2B, the IC package 300 may further include a connection pad 311, a third electrical connection structure 333, an encapsulant 340, a passive component 350, and a heat slug 390.

The connection pad 311 may electrically connect the IC 310 and the connection member 200 to each other. For example, the IC 310 may include an upper, active surface and a lower, inactive surface, and the connection pad 311 may be disposed on the active surface. For example, the IC 310 may be electrically connected to the connection member 200 via the active surface.

The passive component 350 is a component that does not directly receive power/control, such as a capacitor or an inductor. Since the second antenna part 400 is disposed in the second region R2 of the connection member 200, the IC package 300 may replace the disposition space of the second antenna part 400 with a receiving space of the passive component 350. Accordingly, the IC package 300 may accommodate more passive components 350 as compared with the unit size of the passive components 350.

The encapsulant 340 may encapsulate the IC 310 and the passive component 350. For example, the encapsulant 340 may be implemented with a photoimageable encapsulant (PIE), an Ajinomoto build-up film (ABF), an epoxy molding compound (EMC), or the like.

The heat slug 390 may be in contact with the inactive surface of the IC 310 or may be disposed below the inactive surface of the IC 310. Accordingly, the heat slug 390 may easily absorb heat generated by the IC 310. The heat slug 390 may have a lump form to accommodate a large amount of heat.

Since the third electrical connection structure 333 may be connected to the heat slug 390, it may provide a heat dissipation path received in the heat slug 390. Since the third electrical connection structure 333 may be connected to a set substrate, a portion of the heat received in the heat slug 390 may be transferred to the set substrate.

The second and third electrical connection structures 332 and 333 may be disposed together on a bottom surface of the IC package 300. Accordingly, the IC package 300 may reduce an entire size of the antenna module 1-2, while securing a signal transmission path and improving heat dissipation performance.

The antenna module 1-2 may easily secure the disposition space of the second antenna part 400 without substantially affecting the disposition space of each component included in the IC package 300. Therefore, omni-directional RF signal transmission and reception performance may be easily improved as compared with a size of the antenna module 1-2.

Still referring to FIG. 2B, the core member 360 may include a core wiring layer 361, a core insulating layer 362, a core via 365, and a plating member 370, and may surround the IC 310.

The core member 360 and the plating member 370 may be implemented through a fan-out panel level package (FOPLP) method, but other implementation methods are possible. The term "fan-out" refers to a structure in which the electrical connection path diverges from the connection pad 311 of the IC 310 in the X direction and/or the Y direction, and the electrical connection path may extend to a position corresponding to the first patch antenna pattern 111 and/or the core member 360.

The core wiring layer 361 and the core insulating layer 362 may be alternately laminated. For example, the core wiring layer 361 may be formed of the same material as that of the first, second and third ground layers 211, 212, and 213 of the connection member 200, while the core insulating layer 362 may be formed of the same material as that of the rigid region R22 of the connection member 200. However, the core wiring layer 361 and the core insulating layer 362 are not limited to the aforementioned materials.

The core via 365 may be electrically connected to the core wiring layer 361 and may be electrically connected to the first and second electrical connection structures 331 and 332. The core vias 365 may form a transmission path for the base signal to be generated in the IC 310 or provided to the IC 310.

The plating member 370 may be disposed on a side surface of the core member 360 and may be electrically connected to the heat slug 390. Accordingly, the plating member 370 may provide a dissipation path for heat accommodated in the heat slug 390. In addition, the plating member 370 may electromagnetically isolate the IC 310 from the outside environment thereof.

Referring to FIG. 2C, in the antenna module 1-3, the IC package 300 may not include the core member 360 illustrated in FIG. 2B. The connection member 200 may further include a third region R3 extending further than the antenna package 100 in a direction different from an extension direction of the second region R2.

The third region R3 may provide a layout space of a base signal line through which the base signal passes. The third region R3 may be implemented with a material that is relatively more flexible than that of the antenna package 100 or the first region R1. As a result, the third region R3 may be bent flexibly, and thus, may be disposed more freely on the set substrate. For example, the arrangement position of the antenna module 1-3 on a set substrate may be more freely selected.

FIGS. 3A to 3D are plan views illustrating a first array structure of antenna parts of antenna modules, according to embodiments.

Referring to FIGS. 3A to 3D, antenna modules 1111, 1112, 1113, 1121, 1122, 1123, 1124, 1131, 1132, 1133, 1134, 1141, 1142, 1143, and 1144, according to examples, may have a structure in which the first antenna parts 101 and 102, or the first antenna part 100, and second antenna parts 401 and 402 are arranged together side-by-side in a first direction. For example, the first antenna parts 101 and 102, or the first antenna part 100, and the second antenna parts 401 and 402 may be arranged in an 8×1 structure.

The first antenna parts 101 and 102 and the first antenna parts 100 may be configured to have a first resonant frequency, and the second antenna parts 401 and 402 may be configured to have a second resonant frequency different from the first resonant frequency.

Figure 3A:
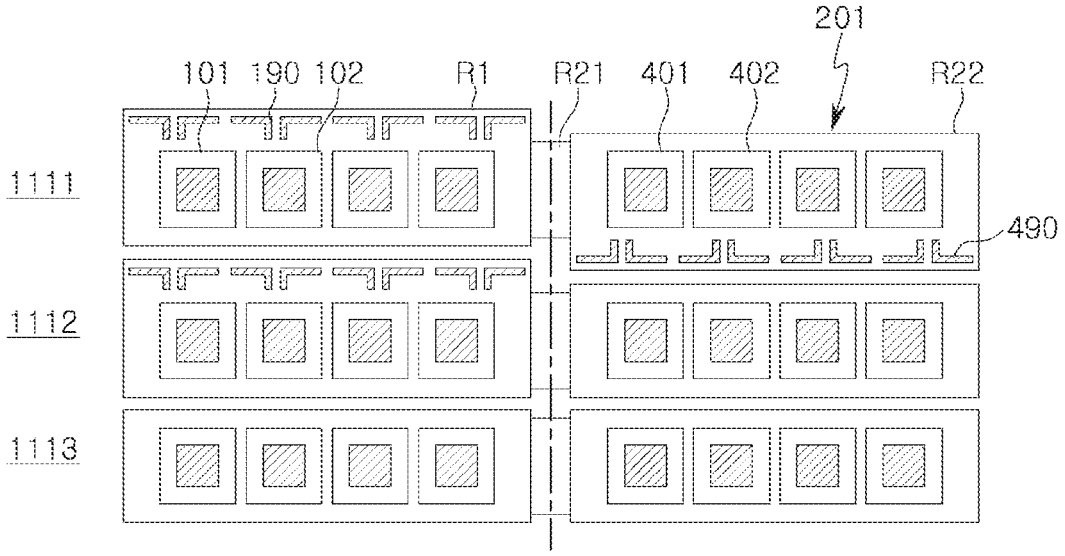
FIGS. 3A to 3D are plan views illustrating a first array structure of antenna parts of antenna modules, according to embodiments.
Figure 3B:
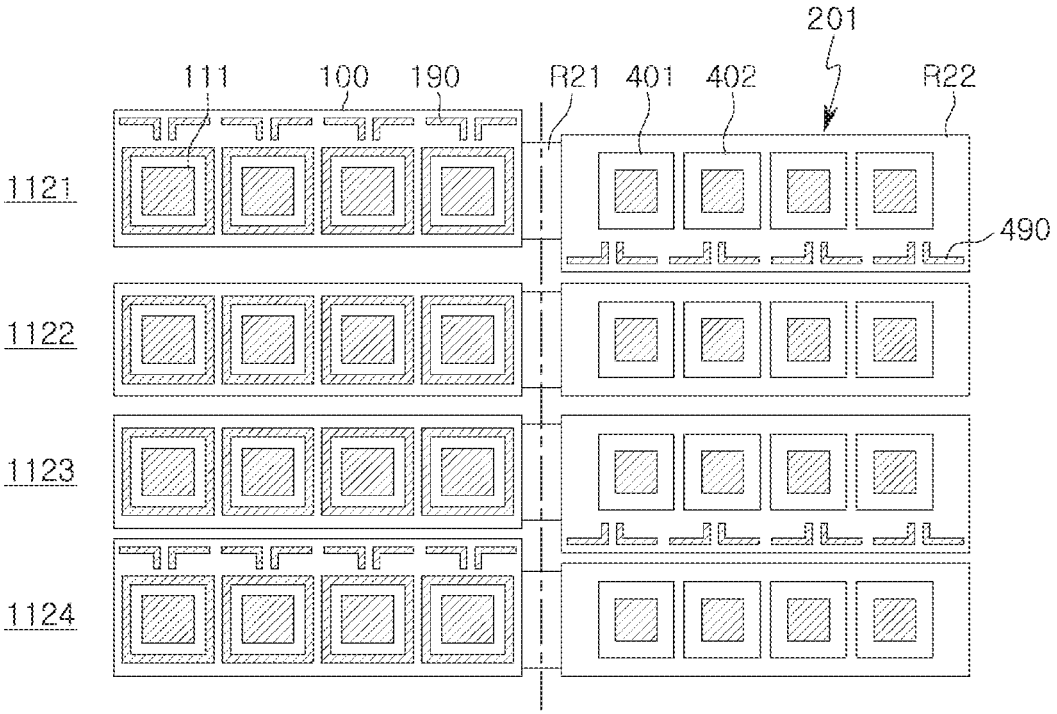

Referring to FIGS. 3A and 3B, connection members 201 of the antenna modules 1111, 1112, 1113, 1121, 1122, 1123, and 1124 may include a first region R1, a flexible region R21 of a second region, and a rigid region R22 of a second region.

Figure 3C:
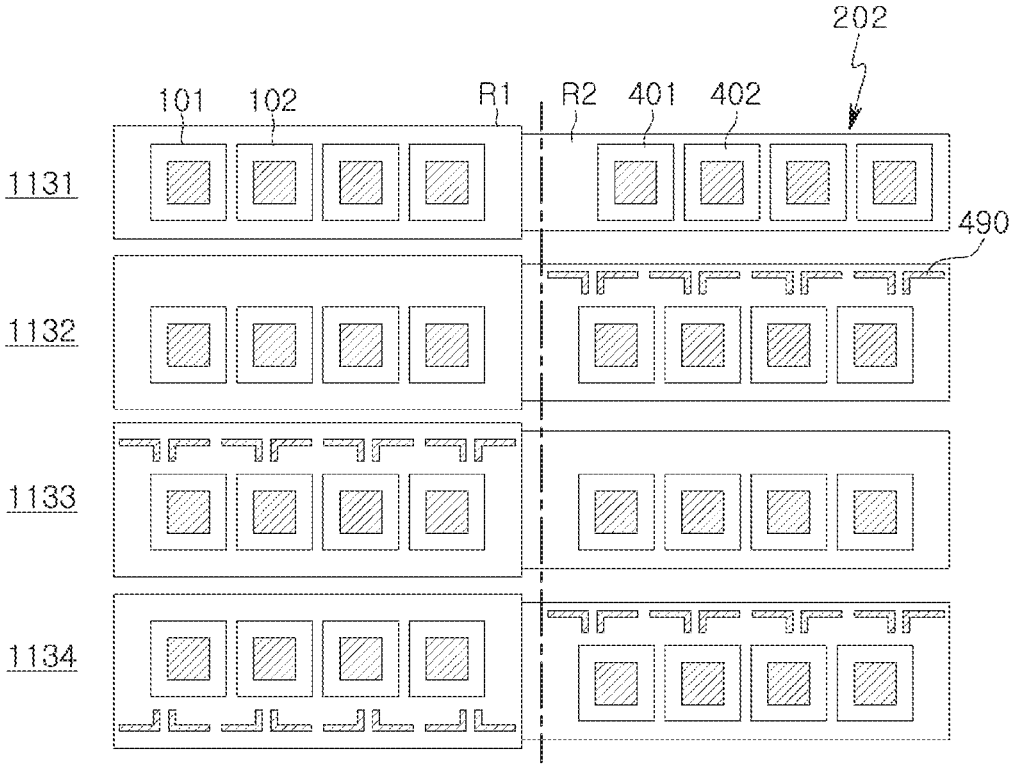
Figure 3D:
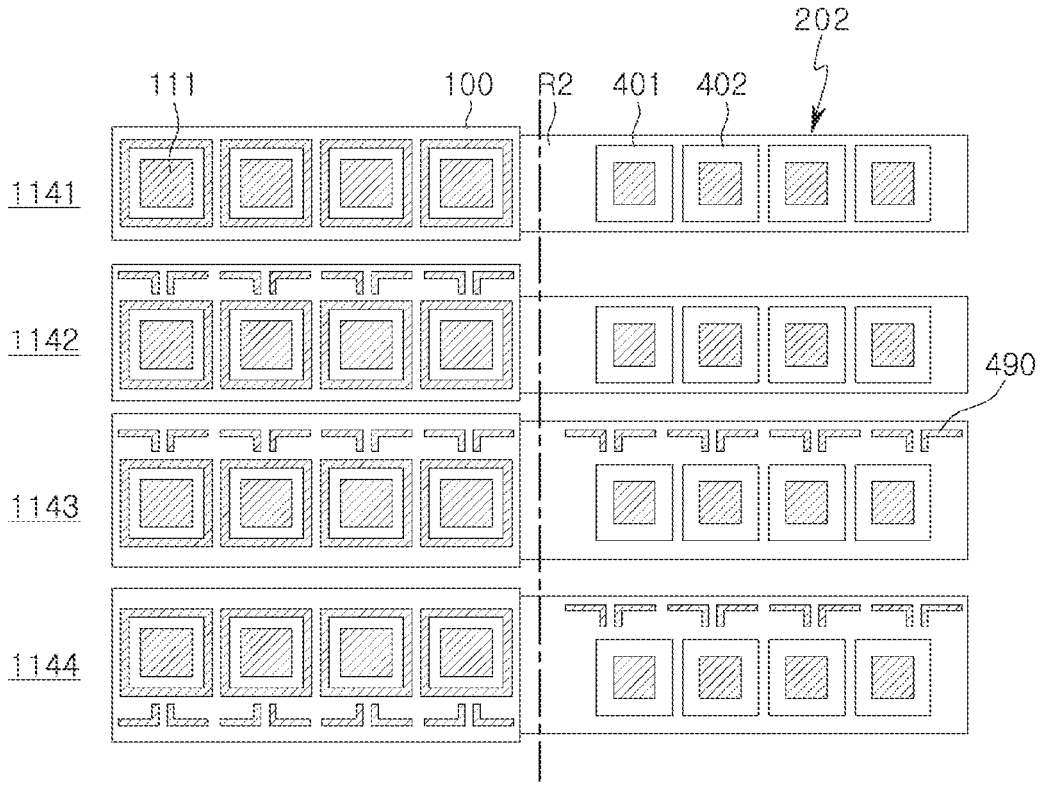

Referring to FIGS. 3C and 3D, connection members 202 of the antenna modules 1131, 1132, 1133, 1134, 1141, 1142, 1143, and 1144 may include a first region R1 and a second region R2.

Referring to FIGS. 3A and 3C, the first antenna parts 101 and 102 may have substantially the same structure as the second antenna parts 401 and 402, and may have a structure mounted on the connection member 201/202.

Referring to FIGS. 3B and 3D, unlike the second antenna parts 401 and 402, the first antenna part 100 may have a structure integrated with respect to the first region R1.

An antenna module in FIGS. 3A to 3D includes an end-fire antenna 190 disposed in the first region R1, and an end-fire antenna 490 disposed in the rigid region R22 of the second region.

The end-fire antennas 190 and 490 may remotely transmit and receive an RF signal in a horizontal direction, and may have a structure of a dipole antenna or a monopole antenna. However, the end-fire antennas 190 and 490 are not limited to dipole or monopole structures. The antenna modules 1111, 1112, and 1113, for example, may further widen an RF signal radiation direction using the end-fire antennas 190 and 490.

FIGS. 4A to 4D are plan views illustrating a second array structure of antenna parts of antenna modules, according to embodiments.

Referring to FIGS. 4A to 4D, antenna modules 1211, 1212, 1213, 1221, 1222, 1223, 1224, 1231, 1232, 1233, 1234, 1241, 1242, 1243, and 1244 may have a structure in which the first antenna parts 101 and 102, or the first antenna part 100, and the second antenna parts 401 and 402 are arranged side-by-side in a first direction. For example, the first antenna parts 101 and 102, or the first antenna part 100, and the second antenna parts 401 and 402 may be arranged in a 4×2 structure.

The first antenna parts 101 and 102 and the first antenna part 100 may be configured to have a first resonant frequency, and the second antenna parts 401 and 402 may have a second resonant frequency different from the first resonant frequency.

Figure 4A:
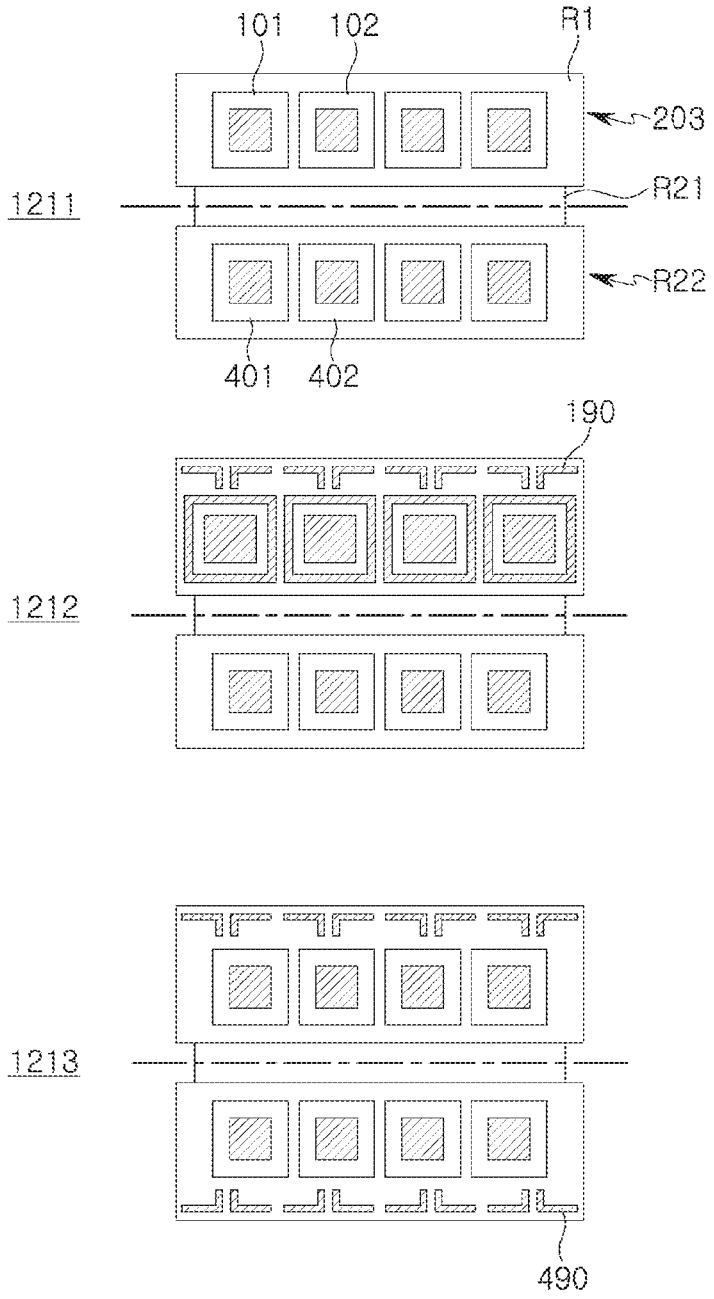
FIGS. 4A to 4D are plan views illustrating a second array structure of antenna parts of antenna modules, according to embodiments.
Figure 4B:
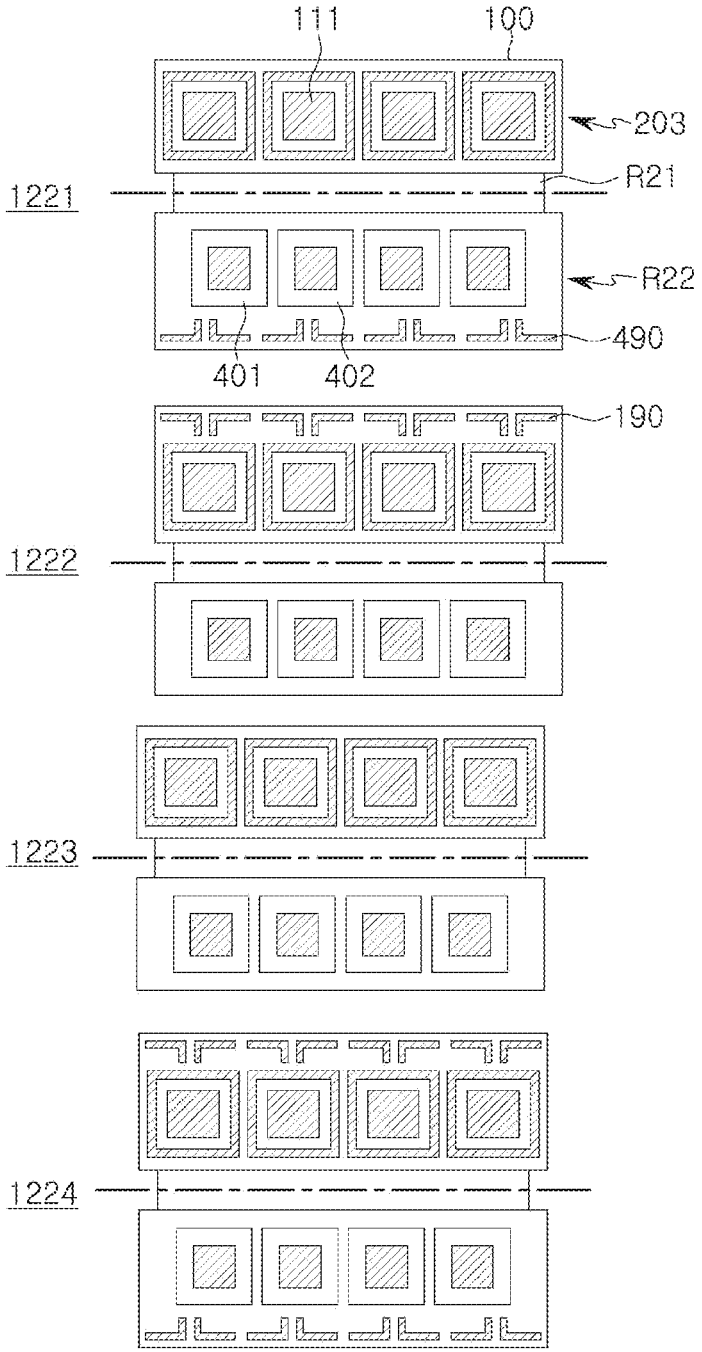

Referring to FIGS. 4A and 4B, connection members 203 of the antenna modules 1211, 1212, 1213, 1221, 1222, 1223, and 1224 may include a first region R1, a flexible region R21 of a second region, and a rigid region R22 of a second region.

Figure 4C:
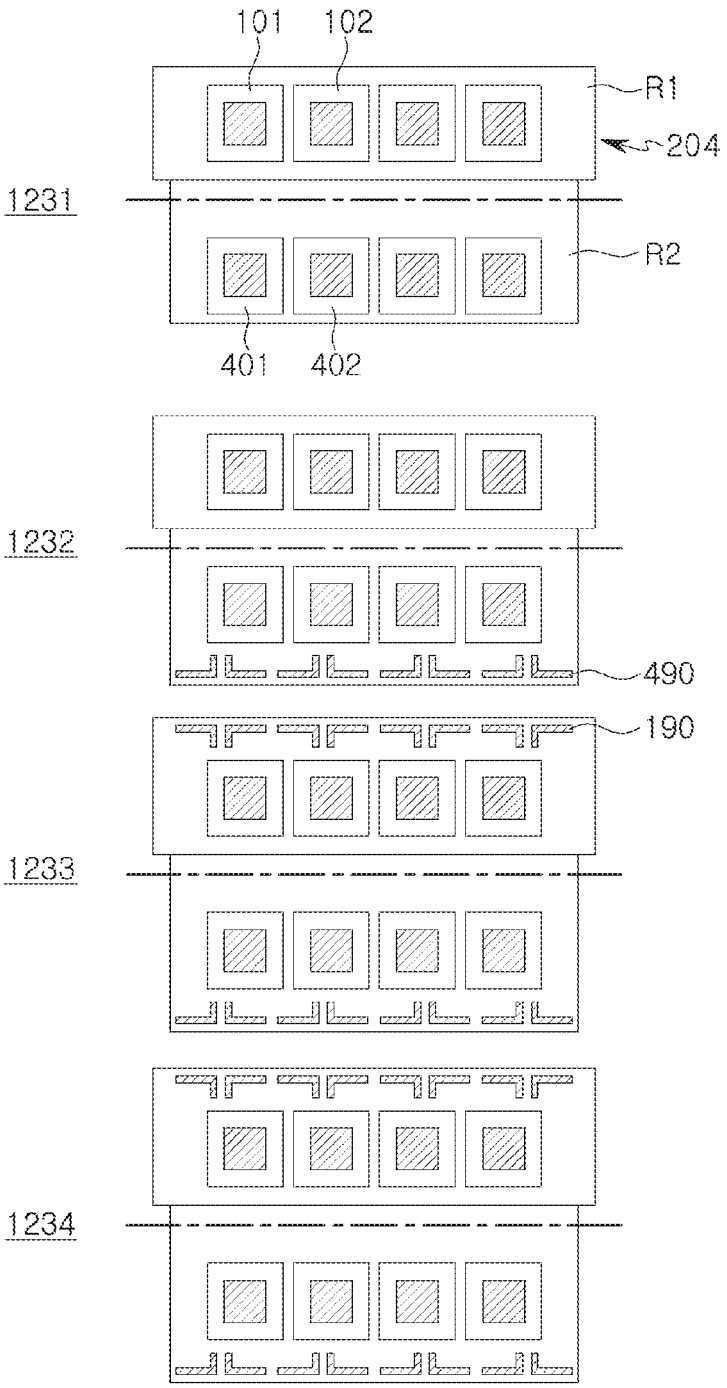
Figure 4D:
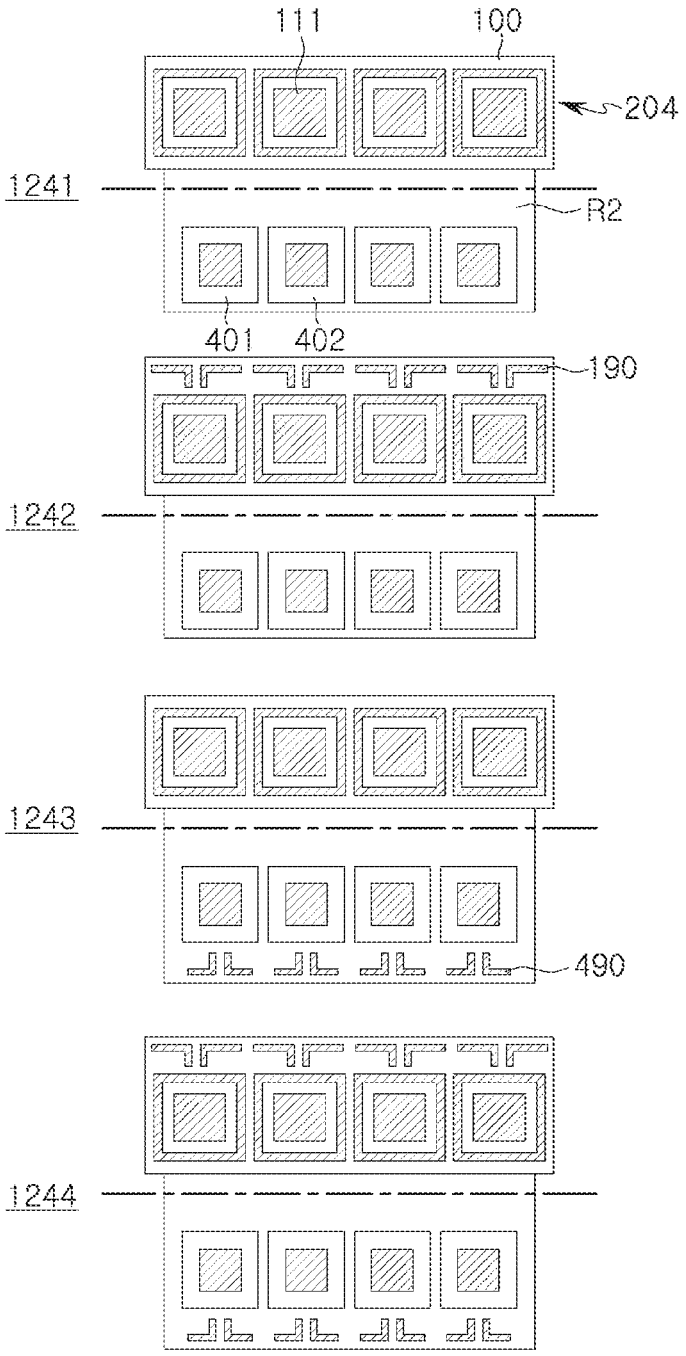

Referring to FIGS. 4C and 4D, connection members 204 of the antenna modules 1231, 1232, 1233, 1234, 1241, 1242, 1243, and 1244 may include a first region R1 and a second region R2.

Referring to FIGS. 4A and 4C, the first antenna parts 101 and 102 may have substantially the same structure as the second antenna parts 401 and 402, and may have a structure mounted on the connection member 203/204.

Referring to FIGS. 4B and 4D, unlike the second antenna parts 401 and 402, the first antenna part 100 may have a structure integrated with respect to the first region R1.

FIGS. 5A to 5D are plan views illustrating a third array structure of antenna parts of antenna modules, according to embodiments.

Referring to FIGS. 5A to 5D, antenna modules 1311, 1312, 1313, 1321, 1322, 1323, 1324, 1331, 1332, 1333, 1334, 1341, 1342, 1343, and 1344 may have a structure in which the first antenna parts 101 and 102 are arranged side-by-side in a first direction, or the first antenna part 100 is arranged to extend in the first direction, and the second antenna parts 401 and 402 are arranged side-by-side in a second direction. For example, the first antenna parts 101 and 102, or the first antenna part 100, and the second antenna parts 401 and 402 may be arranged in an L shape.

The first antenna parts 101 and 102 and the first antenna part 100 may be configured to have a first resonant frequency, and the second antenna parts 401 and 402 may be configured to have a second resonant frequency different from the first resonant frequency.

Figure 5A:
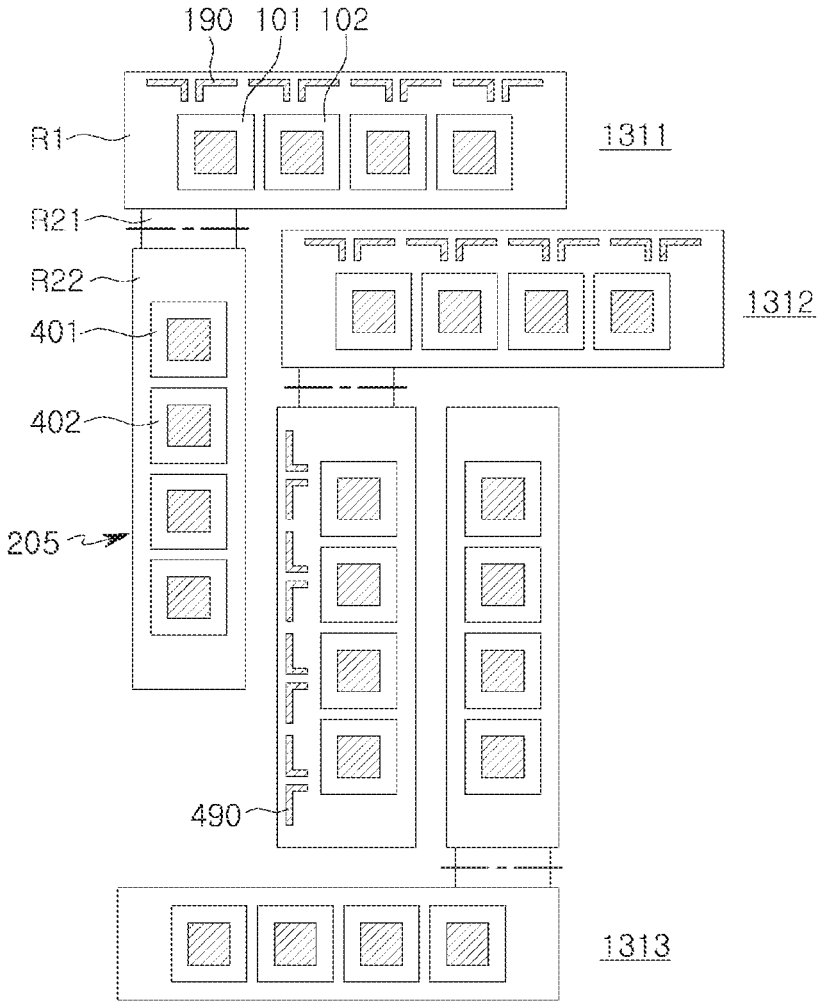
FIGS. 5A to 5D are plan views illustrating a third array structure of antenna parts of antenna modules, according embodiments.
Figure 5B:
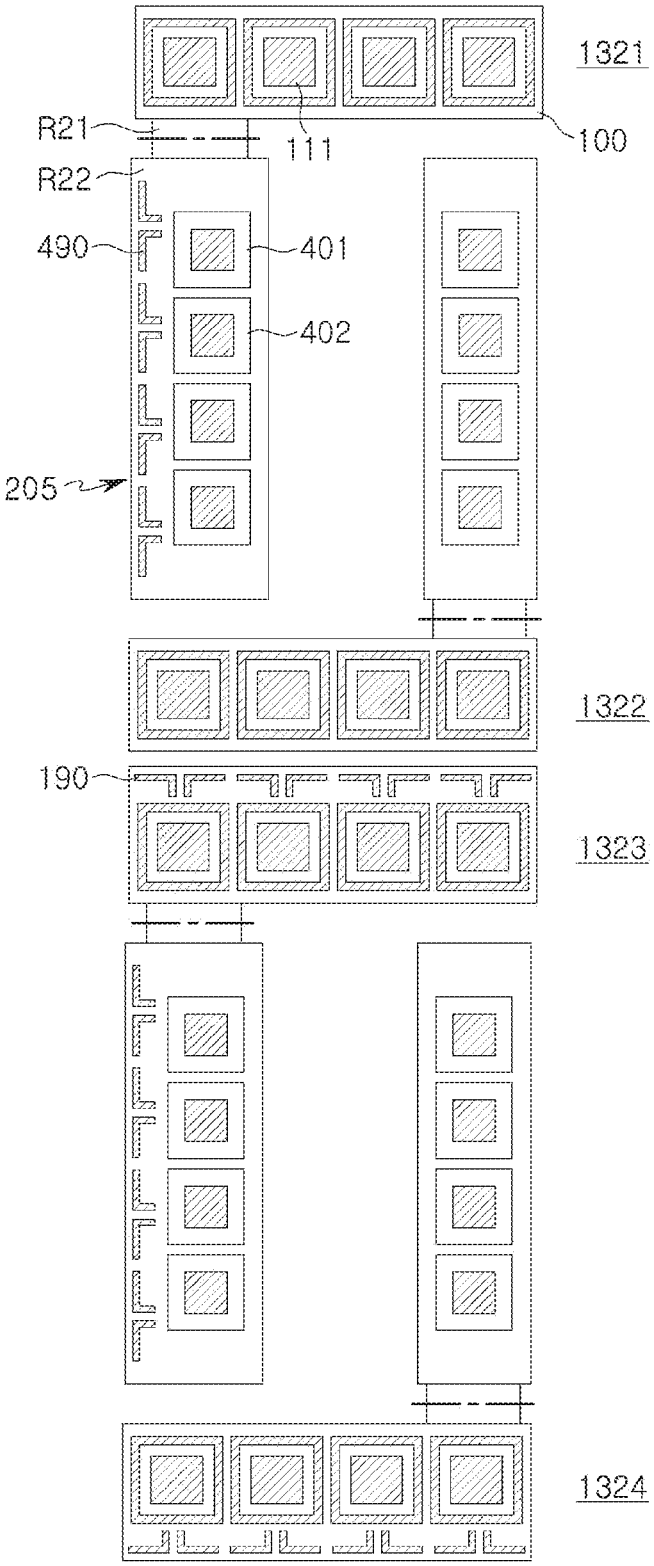

Referring to FIGS. 5A and 5B, connection members 205 of the antenna modules 1211, 1212, 1213, 1221, 1222, 1223, and 1224 may include a first region R1, a flexible region R21 of a second region, and a rigid region R22 of a second region.

Figure 5C:
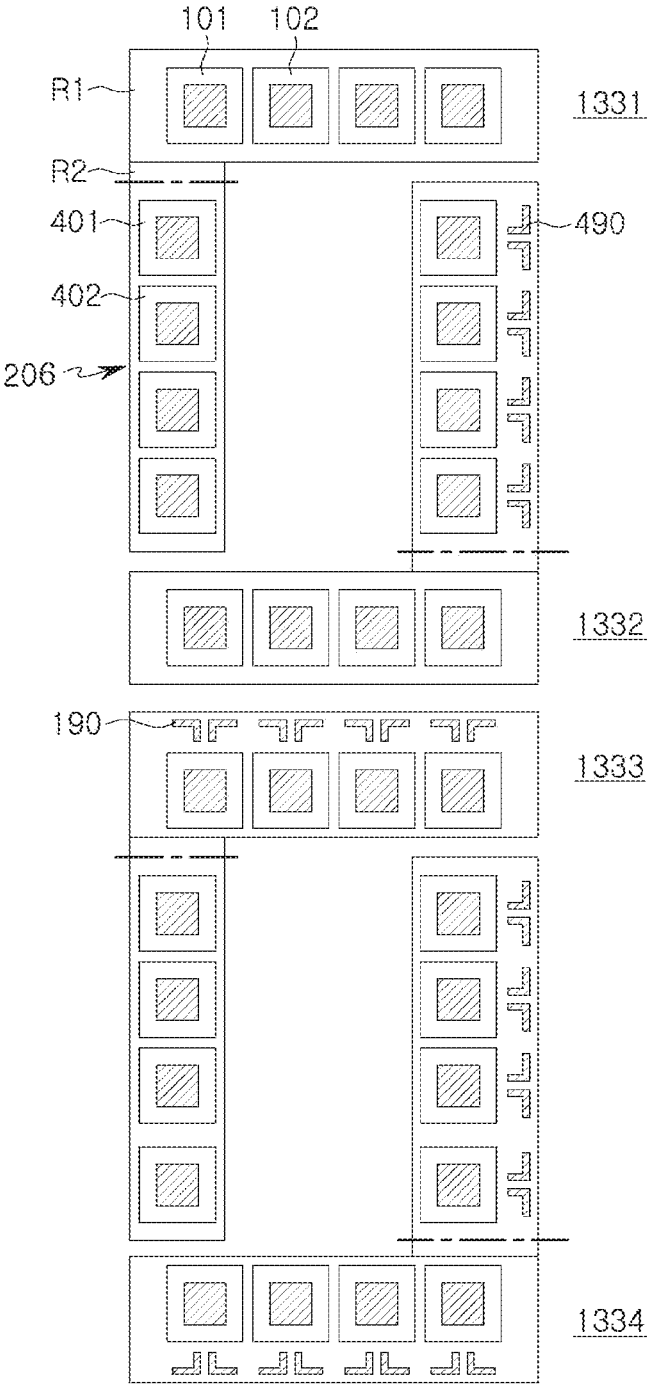
Figure 5D:
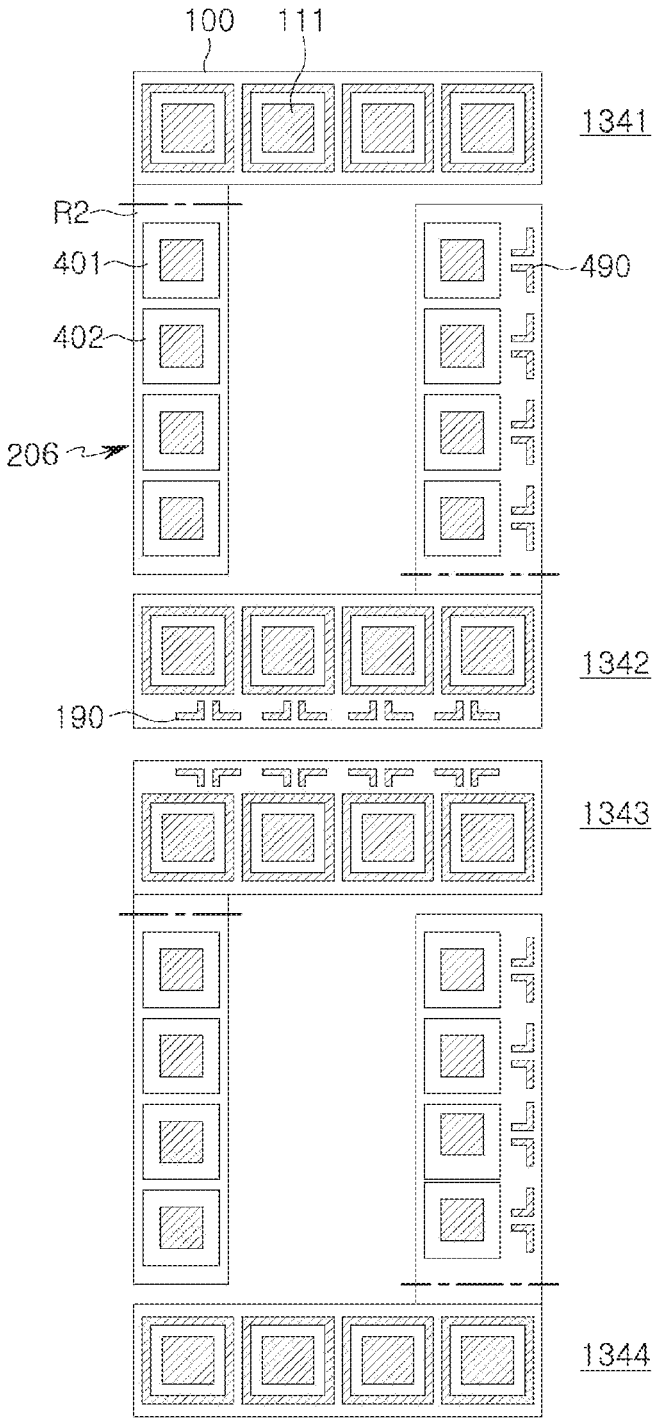

Referring to FIGS. 5C and 5D, connection members 206 of the antenna modules 1231, 1232, 1233, 1234, 1241, 1242, 1243, and 1244 may include a first region R1 and a second region R2.

Referring to FIGS. 5A and 5C, the first antenna parts 101 and 102 may have substantially the same structure as the second antenna parts 401 and 402, and may have a structure mounted on the connection member 205/206.

Referring to FIGS. 5B and 5D, unlike the second antenna parts 401 and 402, the first antenna part 100 may have a structure integrated with respect to the first region R1.

Figure 6A:
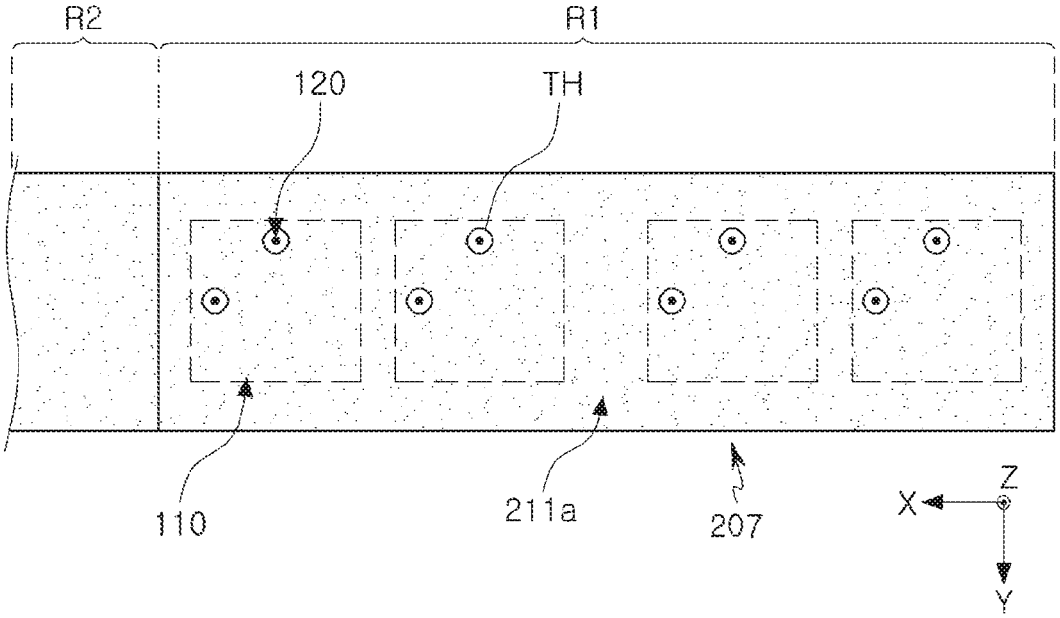
FIGS. 6A and 6B are plan views illustrating a first region of a connection member of an antenna module, according to an embodiment.
Figure 6B:
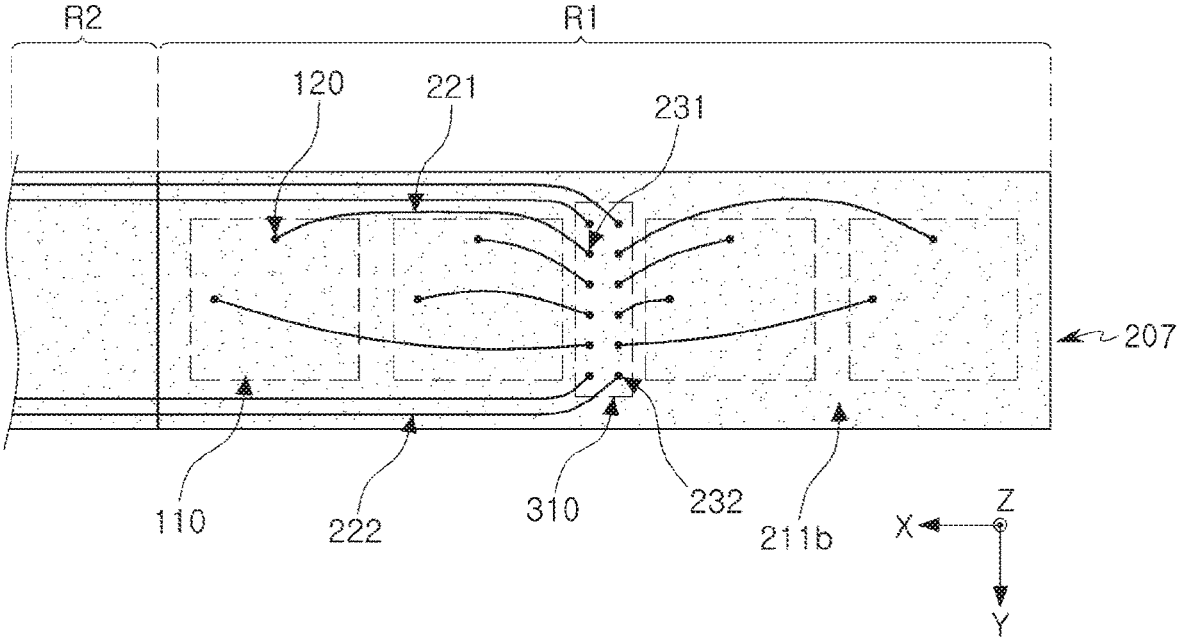

FIGS. 6A and 6B are plan views illustrating a first region of a connection member 207 of an antenna module, according to an embodiment.

Referring to FIG. 6A, a first ground layer 211*a* of the connection member 207 may include through-holes TH, and may overlap a disposition space of a first patch antenna pattern 110 in the Z direction.

First feed vias 120 may penetrate through the through-holes TH, respectively.

Referring to FIG. 6B, a wiring ground layer 211*b* may be disposed closer to an IC than the first ground layer 211*a* illustrated in FIG. 6A, and may provide a disposition space of the first and second feed lines 221 and 222. The wiring ground layer 211*b* may be spaced apart from the first and second feed lines 221 and 222 and may have a shape surrounding the first and second feed lines 221 and 222.

The first feed line 221 may electrically connect the first feed via 120 and the first wiring via 231 to each other.

The second feed line 222 may extend from the second wiring via 232 to the second region R2, and may be electrically connected to a second antenna part.

The first and second wiring vias 231 and 232 may overlap the disposition space of the IC 310 in the Z direction, and may be electrically connected to the IC 310.

Figure 7A:
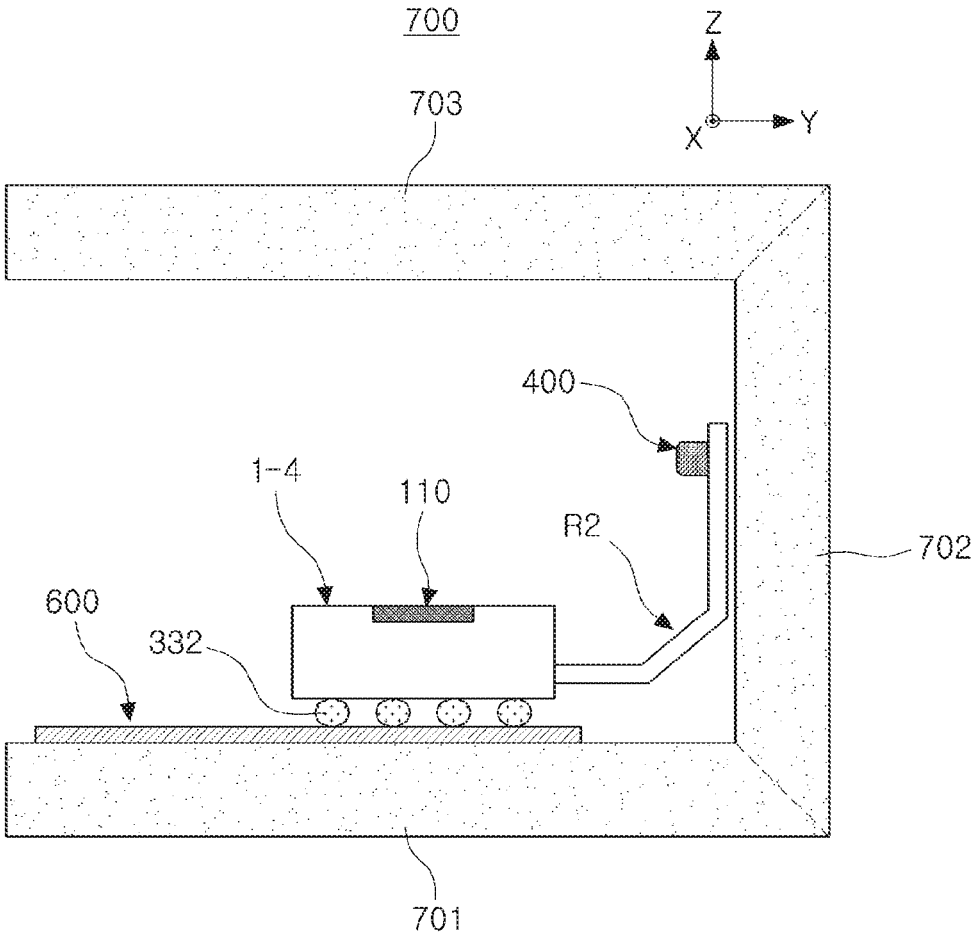
FIGS. 7A and 7B are side views of antenna modules and an electronic device, according to embodiments.
Figure 7B:
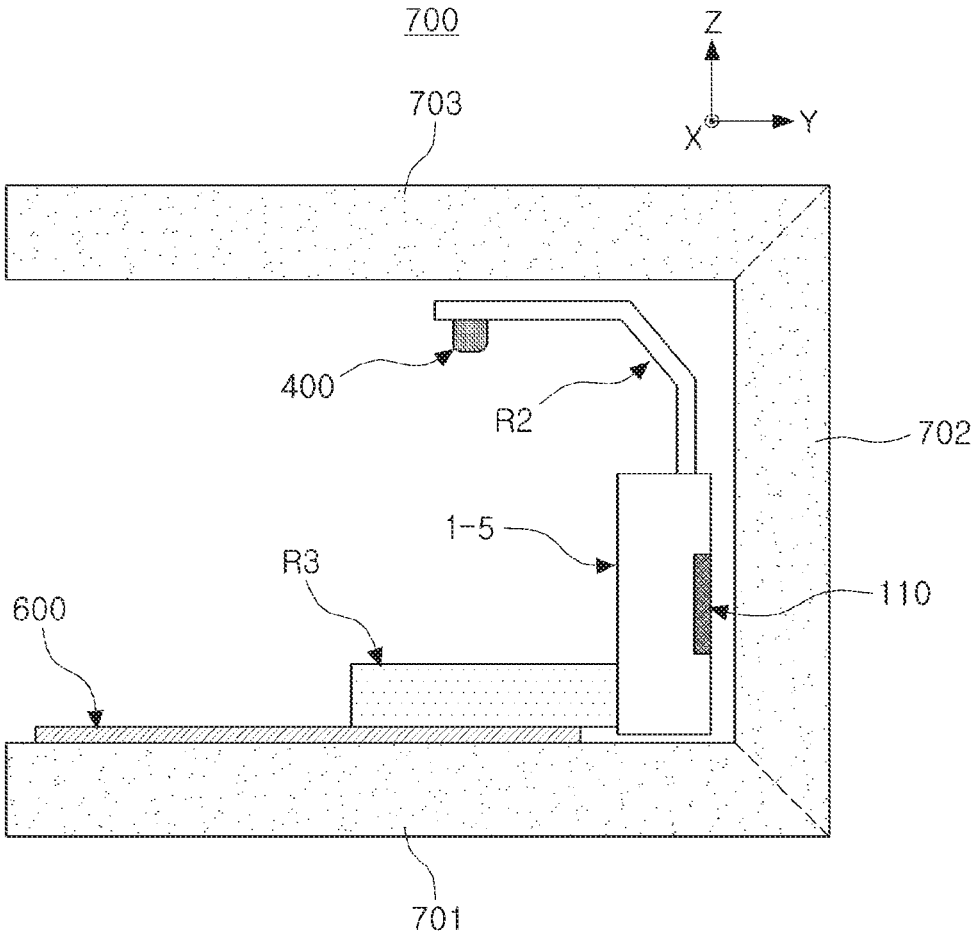

FIGS. 7A and 7B are side views of antenna modules and an electronic device 700, according to embodiments.

Referring to FIG. 7A, the electronic device 700 includes a case having a bottom surface 701, a side surface 702, and a top surface 703, and includes a set substrate 600 disposed in the case.

An antenna module 1-4 may be mounted on the set substrate 600 through the second electrical connection structure 332.

The antenna module 1-4 may be disposed such that a plane of the patch antenna 110 faces the bottom surface 701 or the top surface 703 of the case.

Since the second antenna part 400 may be disposed in a second region R2 of the antenna module 1-4, the second antenna part 400 may be disposed closer to the side surface 702 of the case than the first patch antenna pattern 110.

The side surface 702 of the case may have an area smaller than an area of the bottom surface 701 and/or the top surface 703.

The first antenna part may have a structure in which first patch antenna patterns 110 are arranged side-by-side in a first direction (for example, the Y direction). The second antenna part 400 may have a structure in which second patch antenna patterns 411 are arranged side-by-side in a second direction (for example, the X direction), different from the first direction, and the side surface of the case may be disposed closer to the side surface 702 of the case than the first antenna part (e.g., the first antenna part 100). The antenna module 1-4 may have a third arrangement structure illustrated in FIGS. 5A to 5D.

According to the third arrangement structure, the second antenna part 400 may have a structure in which the second patch antenna patterns 411 are adaptively disposed in a narrow area of the side surface 702 of the case, and the first antenna part 100 including the first patch antenna pattern 110 is disposed to more efficiently avoid an internal obstacles (for example, a battery, a display panel, or the like) and/or an external obstacles (for example, a user's hand).

In addition, the antenna module 1-4 depending on the third arrangement structure may more efficiently reduce electromagnetic interference between the first antenna part 100 and the second antenna part 400.

For example, the first antenna part 100 including the first patch antenna patterns 110 may have a structure arranged adaptively to a narrow Z-direction width of a side surface of the electronic device 700 extending in a Y direction, and the second antenna part 400 may have a structure arranged adaptively to a narrow Z-direction width of a side surface of the electronic device 700 in the Y direction. Therefore, the antenna module 1-4 may have a more advantageous structure to be disposed close to a corner of the electronic device 700.

Referring to FIG. 7B, an antenna module 1-5 may be flexibly connected to the set substrate 600 through the third region R3.

The antenna module 1-5 may be disposed such that a plane of the patch antenna 110 faces the side surface 702 of the case.

The second antenna part 400 may be disposed in the second region R2 of the antenna module 1-5 and may be disposed further away from the side surface 702 of the case than the patch antenna 110. Thus, the electronic device 700 may have a more enhanced gain through the side surface 702 of the case, and may more effectively avoid external obstacles through the bottom surface 701 or the top surface 703 of the case to remotely transmit and receive an RF signal.

For example, the electronic device 700 may include a display panel, and a display surface of the display panel may face in a −Z direction. In this case, the second antenna part (chip antenna) 400 may be disposed to remotely transmit and receive an RF signal by avoiding a hand of a user who is using the display panel of the electronic device 700.

Figure 8A:
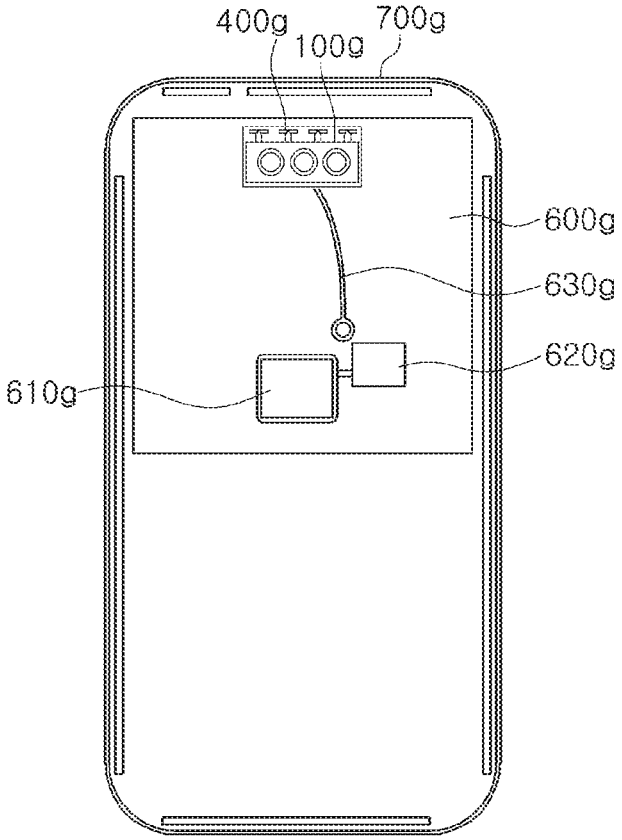
FIGS. 8A to 8C are plan views of electronic devices, according to embodiments.
Figure 8B:
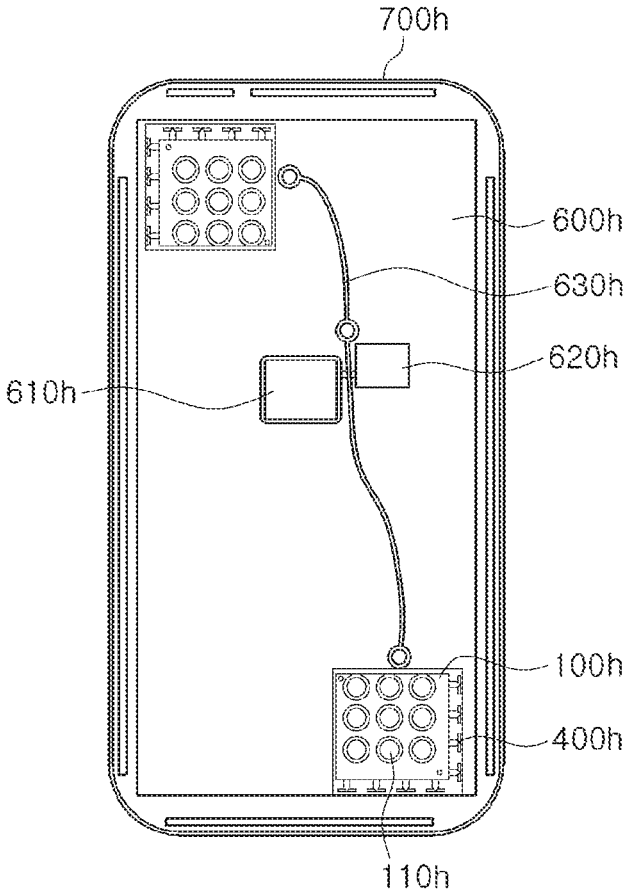
Figure 8C:
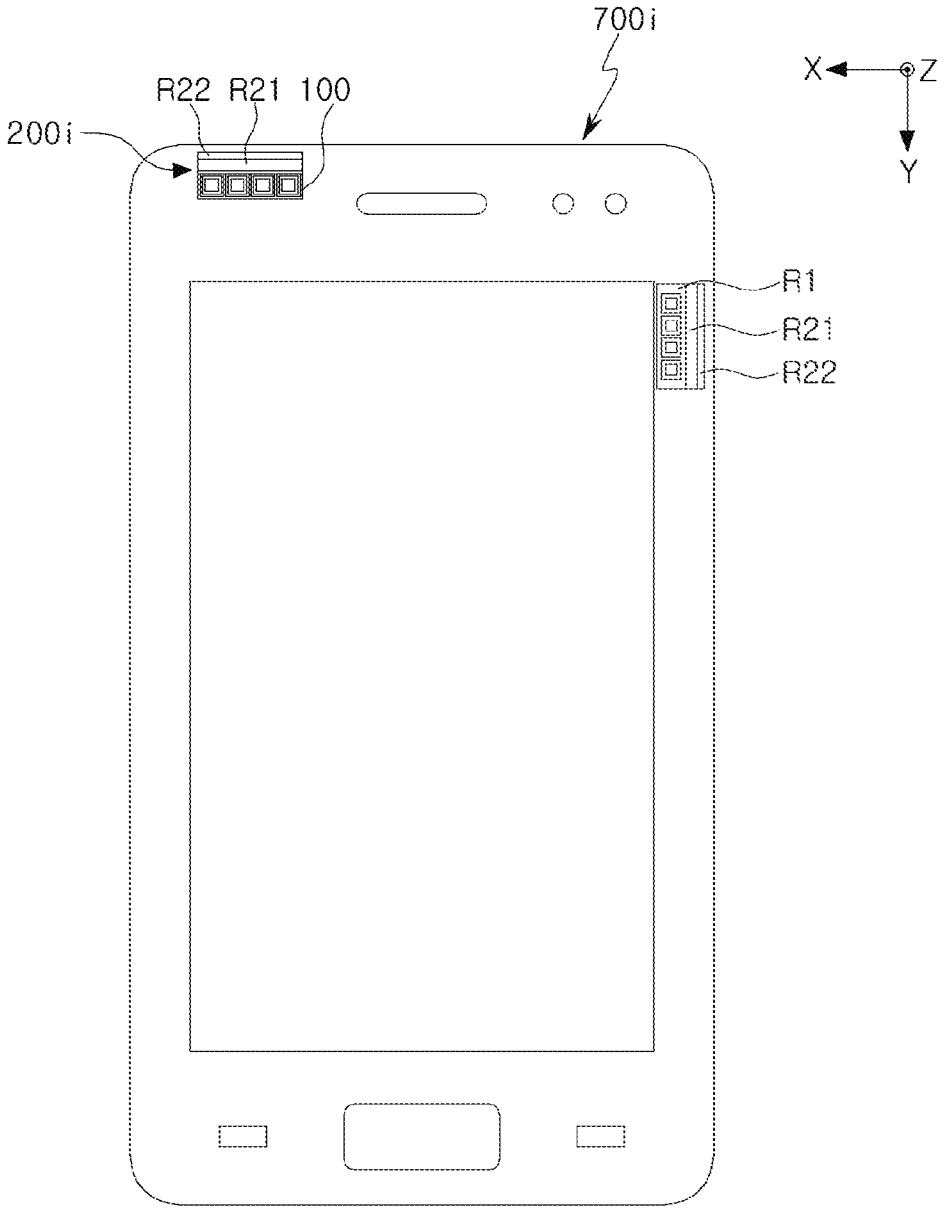

FIGS. 8A to 8C are plan views of electronic devices, according to embodiments.

Referring to FIG. 8A, an antenna module including a first antenna part 100*g* and a second antenna part 400*g* may be disposed on a set substrate 600*g*, and may be disposed in an electronic device 700*g*.

The electronic device 700*g* may be a smartphone, a personal digital assistant, a digital video camera, a digital still camera, a network system, a computer, a monitor, a tablet PC, a laptop computer, a netbook computer, a television set, a video game, a smartwatch, an automobile, or the like, but is not limited to the aforementioned examples.

A communications module 610*g* and a second IC 620*g* may be further disposed on the set substrate 600*g*. The antenna module may be electrically connected to the communications module 610*g* and/or the second IC 620*g* through a coaxial cable 630*g*.

The communications module 610*g* may include at least a portion of: a memory chip such as a volatile memory (for example, a dynamic random access memory (DRAM)), a nonvolatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital (ADC) converter, an application-specific integrated circuit (ASIC), or the like, to perform digital signal processing.

The second IC 620*g* may perform analog-to-digital conversion, amplification of an analog signal, filtering, and frequency conversion to generate a base signal. The base signal input and output through the second IC 620*g* may be transmitted to the antenna module through a coaxial cable. For example, when the base signal is an IF signal, the second IC 620*g* may be implemented as an intermediate frequency integrated circuit (IFIC). When the base signal is a baseband signal, the second IC 620*g* may be implemented as a base band integrated circuit (BBIC).

For example, the base signal may be transmitted to the IC through an electrical connection structure, a core via, and a circuit wiring. The IC may convert the base signal into an RF signal in a millimeter wave (mmWave) band.

Referring to FIG. 8B, antenna modules each including a first antenna part 100*h*, a patch antenna pattern 110*h*, and a second antenna part 400*h* may be disposed to be adjacent to a boundary of one side surface and a boundary of the other side surface of the electronic device 700*h*, on a set substrate 600*h* of the electronic device 700*h*, and a communication module 610*h* and a second IC 620*h* may also be disposed on the set substrate 600*h*. The antenna modules may be electrically connected to the communications module 610*h* and/or the second IC 620*h* through a coaxial cable 630*h*.

Referring to FIG. 8C, an antenna module including a first antenna part 100, a first region R1 of a connecting member 200*i*, a flexible region R21 of a second region of a connecting member, and a rigid region R22 of the second region of the connecting member may be disposed adjacent to a corner of the electronic device 700*i* while the flexible region R21 is bent.

The patch antenna pattern, the coupling patch pattern, the feed via, the feed pattern, the ground layer, the coupling structure, the feed line, the wiring via, the electrical connection structure, the plating member, the heat slug, the electrode, the electrode pad, and the connection pad, disclosed in the present specification, may include a metal material, for example, a conductive material, such as copper (Cu), aluminum (Al), silver (Ag), tin (Sn), gold (Au), nickel (Ni), lead (Pb), titanium (Ti), or alloys thereof, and may be formed by a plating method, such as chemical vapor deposition (CVD), physical vapor deposition (PVD), sputtering, subtractive, additive, a semi-additive process (SAP), a modified semi-additive process (MSAP), or the like. However, the aforementioned components are not limited to the listed materials and formation methods, and may be modified depending on design specifications (for example, flexibility, a dielectric constant, ease of bonding between a plurality of substrates, durability, costs, or the like).

The insulating layer and the dielectric layer herein may be implemented by a prepreg resin, FR4, Low Temperature Co-fired Ceramic (LTCC), Liquid Crystal Polymer (LCP), a thermosetting resin such as epoxy resin, a thermoplastic resin such as polyimide, or a resin formed by impregnating these resins in a core material such as a glass fiber, a glass cloth, a glass fabric, or the like, together with an inorganic filler, Ajinomoto Build-up Film (ABF) resin, Bismaleimide Triazine (BT) resin, a photoimageable dielectric (PID) resin, a copper clad laminate (CCL), a ceramic-based insulating material, or the like.

The RF signals disclosed herein may be used in various communications protocols such as Wi-Fi (IEEE 802.11 family or the like), WiMAX (IEEE 802.16 family or the like), IEEE 802.20, Long Term Evolution (LTE), Ev-DO, HSPA+, HSDPA+, HSUPA+, EDGE, GSM, GPS, GPRS, CDMA, TDMA, DECT, Bluetooth, 3rd Generation (3G), 4G, 5G and various wireless and wired protocols designated thereafter, but are not limited to the provided examples. Further, the frequency of the RF signal (for example, 24 GHz, 28 GHz, 36 GHz, 39 GHz, 60 GHz) is greater than the frequency of the IF signal (for example, 2 GHz, 5 GHz, 10 GHz or the like).

As described above, according to an example, antenna performance (for example, gain, bandwidth, directivity, or the like) may be improved or a structure advantageous for miniaturization may be provided. In addition, an RF signal transmission and reception direction may be easily widened without substantial sacrifice of antenna performance or size, and remote transmission and reception of an RF signal may be efficiently performed by avoiding external obstacles (for example, another component in the electronic device, a hand of a user who is using the electronic device, or the like).

According to an example, overall antenna performance for first and second frequencies that are different from each other may be improved, and electromagnetic interference between the first and second frequencies may be easily reduced without a significant increase in effective size of an antenna module.

The communications modules 610*g* and 610*h* in FIGS. 8A and 8B that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna module, comprising:

an integrated circuit (IC) package comprising an IC;

a first antenna part comprising a first patch antenna pattern, a first feed via electrically connected to the first patch antenna pattern, and a first dielectric layer surrounding the first feed via;

a second antenna part comprising a second patch antenna pattern, a second feed via electrically connected to the second patch antenna pattern, and a second dielectric layer surrounding the second feed via; and a connection member comprising a laminated structure having a first surface, on which the first and second antenna parts are disposed, and a second surface, on which the IC package is disposed, opposing the first surface, the connection member further comprising an electrical connection path between the IC and the first and second feed vias, wherein the connection member has a first region overlapping the IC package, and a second region not overlapping the IC package and being more flexible than the first dielectric layer, wherein the first antenna part is disposed on the first region, wherein the second antenna part is disposed on the second region, and wherein either one or both of the first antenna part and the second antenna part further comprises a connection structure disposed on the first surface and electrically connecting the first feed via or the second feed via and the connection member to each other, and having a melting point lower than a melting point of the first feed via or the second feed via.

2. The antenna module of claim 1, wherein the first antenna part is configured to have a first resonant frequency, and wherein the second antenna part is configured to have a second resonant frequency different from the first resonant frequency.

3. The antenna module of claim 2, wherein the connection member further comprises a third region extending from the first region in a direction different from a direction in which the second region extends, and wherein the third region comprises a disposition space of a base signal line, through which a signal having a frequency lower than the first and second resonant frequencies passes, electrically connected to the IC.

4. The antenna module of claim 1, wherein the IC package further comprises:

a core member spaced apart from the IC, and comprising a core via and a core insulating layer;

a first electrical connection structure electrically connecting an end of the core via and the connection member to each other; and a second electrical connection structure electrically connected to another end of the core via.

5. The antenna module of claim 4, wherein the IC package further comprises:

a heat slug disposed on an inactive surface of the IC; and a third electrical connection structure electrically connected to the heat slug and disposed at a same height as a height of the second electrical connection structure, and wherein the IC is electrically connected to the connection member through a surface opposing the inactive surface.

6. The antenna module of claim 4, wherein the IC package further comprises:

a plating member disposed in the core member;

a passive component electrically connected to the connection member; and an encapsulant encapsulating the IC and the passive component.

7. The antenna module of claim 1, wherein the first region has a thickness greater than a thickness of the second region.

8. The antenna module of claim 1, wherein the second region comprises a rigid region overlapping the second antenna part, and a flexible region not overlapping the second antenna part and being more flexible than the rigid region.

9. The antenna module of claim 8, further comprising an end-fire antenna disposed on either one or both of the rigid region and the first region.

10. The antenna module of claim 1, wherein either one or both of the first antenna part and the second antenna part further comprises a coupling patch pattern disposed over the first or second patch antenna pattern and spaced apart from the first patch antenna pattern or the second patch antenna pattern.

11. The antenna module of claim 10, wherein either one or both of the first antenna part and the second antenna part further comprises a polymer layer disposed between the first patch antenna pattern or the second patch antenna pattern and the coupling patch pattern, and wherein the first dielectric layer or the second dielectric layer is formed of a ceramic material.

12. The antenna module of claim 1, wherein the first antenna part has a structure in which first patch antenna patterns including the first patch antenna pattern are arranged side-by-side in a first direction, and wherein the second antenna part has a structure in which second patch antenna patterns including the second patch antenna pattern are arranged side-by-side in the first direction.

13. The antenna module of claim 12, wherein the first patch antenna patterns and the second patch antenna patterns are arranged together side-by-side.

14. The antenna module of claim 1, wherein the first antenna part has a structure in which first patch antenna patterns including the first patch antenna pattern are arranged side-by-side in a first direction, and wherein the second antenna part has a structure in which second patch antenna patterns including the second patch antenna pattern are arranged side-by-side in a second direction different from the first direction.

15. The antenna module of claim 14, wherein the first patch antenna patterns are configured to have a first resonant frequency, and wherein the second patch antenna patterns are configured to have a second resonant frequency different from the first resonant frequency.

16. An electronic device, comprising:

a case;

a set substrate disposed in the case; and an antenna module disposed in the case and electrically connected to the set substrate, the antenna module comprising an integrated circuit (IC) package comprising an IC;

a first antenna part comprising a first patch antenna pattern, a first feed via electrically connected to the first patch antenna pattern, and a first dielectric layer surrounding the first feed via;

a second antenna part comprising a second patch antenna pattern, a second feed via electrically connected to the second patch antenna pattern, and a second dielectric layer surrounding the second feed via; and a connection member comprising a laminated structure having a first surface, on which the first and second antenna parts are disposed, and a second surface, on which the IC package is disposed, opposing the first surface, the connection member further comprising an electrical connection path between the IC and the first and second feed vias, wherein the connection member has a first region overlapping the IC package, and a second region not overlapping the IC package and being more flexible than the first dielectric layer, wherein the first antenna part is disposed on the first region, wherein the second antenna part is disposed on the second region, and wherein either one or both of the first antenna part and the second antenna part further comprises a connection structure disposed on the first surface and electrically connecting the first feed via or the second feed via and the connection member to each other, and having a melting point lower than a melting point of the first feed via or the second feed via.

17. The electronic device of claim 16, wherein the connection member further comprises a third region electrically connecting the second region and the set substrate to each other and being more flexible than the first dielectric layer.

18. The electronic device of claim 16, wherein the case comprises a first case surface and a second case surface having an area smaller than an area of the first case surface, wherein the first antenna part has a structure in which first patch antenna patterns including the first patch antenna pattern are arranged side-by-side in a first direction, and wherein the second antenna part has a structure in which second patch antenna patterns including the second patch antenna pattern are arranged side-by-side in a second direction different from the first direction, and the second antenna part is disposed closer to the second case surface than the first antenna part.

19. The electronic device of claim 16, wherein the first antenna part is configured to have a first resonant frequency, and wherein the second antenna part is configured to have a second resonant frequency different from the first resonant frequency.

* * * * *